United States Patent [19]

Dersch et al.

[11] 4,037,578

[45] July 26, 1977

[54] IGNITION SAFETY CONTROL SYSTEM

[75] Inventors: James E. Dersch, Mound; James L. Maciey, Rosemount, both of Minn.

[73] Assignee: Nautec, Inc., Excelsior, Minn.

[21] Appl. No.: 599,468

[22] Filed: July 28, 1975

Related U.S. Application Data

[63] Continuation of Ser. No. 504,155, Sept. 9, 1974, abandoned, which is a continuation of Ser. No. 339,856, March 9, 1973, abandoned.

[51] Int. Cl.[2] ..... F02N 17/00; B63J 2/00

[52] U.S. Cl. ..... 123/179 BG; 114/211; 307/9; 307/116

[58] Field of Search ..... 123/179 B, 179 BG; 114/211; 307/9, 116

[56] References Cited

U.S. PATENT DOCUMENTS

| | | | |
|---|---|---|---|
| 3,315,584 | 4/1967 | Van Ranst | 123/179 B |
| 3,489,912 | 1/1970 | Hoffman | 123/179 B |
| 3,599,591 | 8/1971 | Edelson | 114/211 |
| 3,662,727 | 5/1972 | Abplanalp | 123/179 B |
| 3,675,034 | 7/1972 | Abplanalp | 114/211 |
| 3,948,202 | 4/1976 | Yoshikawa | 114/211 |
| 3,951,091 | 4/1976 | Doench | 123/179 B |

*Primary Examiner*—Carroll B. Dority, Jr.
*Assistant Examiner*—Ronald B. Cox
*Attorney, Agent, or Firm*—Merchant, Gould, Smith, Edell, Welter & Schmidt

[57] ABSTRACT

An automatic digital safety system for controlling the starting and continued energization of one or more internal combustion engines within an engine compartment and for controlling the energization of exhaust blowers in fluid communication with the engine compartment. A guardian control unit disables starter motors and ignition coils of the engines, while simultaneously energizing the exhaust blowers for a first predetermined time interval after their ignition switches are turned ON. Blower sensor circuits sense the energized state of the blowers. Whenever the sensors indicate that the blowers are not energized when enabled, the system disables the engines. After the first predetermined time interval, the engine coils and starters are enabled and the blowers remain energized. If the ignition switches are turned off after the first predetermined time interval, the engines will remain enabled for a second predetermined time interval and the blowers will remain running for a third predetermined time interval after the switches are turned OFF. Engine sensor networks sense the operative state of the engines. If the engines are started when enabled to do so, and continuously remain running for a fourth predetermined time interval, the blowers are deenergized. Whenever an engine stops running ater the fourth predetermined time interval, and its ignition switch is ON, the blowers are automatically reenergized.

12 Claims, 7 Drawing Figures

IGNITION SAFETY CONTROL SYSTEM

This is a continuation of application Ser. No. 504,155 abandoned, filed Sept. 9, 1974, which is a continuation of application 339,856 abandoned, filed Mar. 9, 1973.

BACKGROUND OF THE INVENTION

1. Field of the Invention

This invention relates generally to safety control systems and more specifically to an ignition safety control system for preventing energization of electrical components within an engine compartment until the compartment has been sufficiently ventilated of flammable vapors.

2. Description of the Prior Art

Substantially enclosed compartments housing internal combustion engines are particularly susceptible to dangerous explosions resulting from ignition, by electrical components of the engines, of combustible vapors trapped therein. The above problem is particularly acute in vehicles such as power boats where the engine compartments may remain closed for prolonged periods of time enabling highly volatile fuels such as gasoline or diesel fuel within the chamber —whether from the carburetor, leaks in fuel lines or the like —to vaporize and become entrapped within the compartment in dangerously explosive concentrations. Sparks from the starter motors brushes, the ignition coil or the distributor which are normally produced in the subsequent starting or running of an engine within the compartment may cause the entrapped vapors to ignite resulting in an explosion and fire that can severely damage or destroy the entire boat and cause serious injury to individuals thereon.

Boat manufacturers, recognizing the above problem, have typically provided the boat engine compartment with a ventilating apparatus including a blower in fluid communication with the engine compartment for exhausting the explosive vapors therefrom. The foregoing problem has also been specifically recognized in regulations promogated by the United States Coast Guard which require a definite period for clearing vapors from the engine compartment to elapse, before the engine can be operated. As a result, various ignition lockout devices have been designed for use specifically with the ignition systems of power boats.

The conventional ventilation blower for the engine compartment is generally operated by a manual switch on the control console of the boat, and does not inhibit the ignition switch of the engine. Modifications of the basic blower have included vapor detectors located within the compartment or time delay elements for providing visual or audible warnings to the boat operator indicating the explosive condition of the compartment. With the basic blower systems, however, the boat operator was entirely free to disregard the warnings and to start the engine before the blower had been operated a sufficient length of time to insure proper ventilation of the engine compartment.

Various ignition safety lockout devices have appeared in the prior art which include combinations of the vapor detector and visual or audible operator warning safety features. These safety ignition lockout devices typically operate in response to a movement of the ignition switch for starting an engine within the engine compartment from its OFF to its ON position. Various configurations have been introduced to either physically prevent the operator from advancing the ignition switch to its START position or to electrically disable energization of the engine's starter motor until the engine compartment had been properly ventilated.

A first group of the prior art ignition lockout devices have ignition disabling apparatus controlled by a vapor detector within the engine compartment. Such devices depend for their reliability upon the accuracy, the proper functioning and proper location of the vapor detector within the engine compartment. Further, rugged environmental conditions to which such gas detectors are typically exposed in such systems render their use undesirable from a reliability standpoint.

A second group of prior art ignition safety lockout devices include apparatus for establishing a time delay period during which the starter motor of the engine is disabled simultaneously with the activation of an exhaust blower within the compartment. Such devices have typically employed temperature responsive elements such as bimetallic strip configurations or time delay relays for establishing the desired time delay. The repetitive timing accuracy of such elements obviously depends in part upon the ambient temperature and upon the frequency at which these devices are energized. Further, the reliability of such electromechanical devices depends upon the particular construction and wear of the electromechanical parts.

Most prior art ignition safety lockout systems are further designed to deenergize the exhaust blower prior to or simultaneously with the starting of the engine. Such systems do not provide for removal of explosive vapors which may accumulate within the engine compartment during the starting sequence of the engine, but rely upon the exhausting capabilities of the engine itself to clear such vapors from the compartment when the engine is running.

One prior art system includes relay apparatus for maintaining the blower in an energized state for a predetermined time period following any attempt to start the engines within the engine compartment. The continued blower activation, however, requires that the ignition switch be maintained in an ON position. Further, while this system provides for enabling of the blower, it does not sense whether or not the blower has actually been energized as assumed.

The prior art ignition safety lockout devices do not detect the successful starting of enabled engines after the initial exhaust expulsion time delay period, nor do they sense the operative state of the engines thereafter. Their operation, therefore, is generally not dependent upon the operative state of the engines being controlled. If an attempted restart of the engine is tried after the ignition key has been turned to its OFF position, most prior art systems require a complete recycling for an additional predetermined time delay period regardless of the time interval between successive engine start attempts.

The disadvantages of the prior art ignition safety control devices are overcome by the novel ignition safety control system of the present invention. The ignition safety control system of the present invention senses the operative state of both blower(s) and engine(s) within the engine compartment and automatically enables the energization thereof based upon the occurrence of logical sequences of predetermined events and time periods.

Besides providing for proper initial engine compartment ventilation, the system of the present invention enables repetitive attempts to start the engine(s) without system recycling after the ignition switch has been turned to its OFF position and provides for post start blower activation control based upon the operative status of the engine(s).

While the present invention will be described in conjunction with its use in a power boat, it will be understood that the invention is not limited to this use, but is applicable for use in the ignition system of any internal combustion engine housed in an engine compartment susceptible of accumulating explosive vapors.

Further, while the present invention is described with reference to specific embodiments of switching, timing, and other logic circuitry, it will be understood that the invention is not limited to the use of the specific circuits of the preferred embodiment, but, that any equivalent circuits may be used which perform the same functions without departing from the spirit or intent of this invention.

SUMMARY OF THE INVENTION

The ignition safety control system of the present invention is operatively connected to control the energization of the ignition coil and starter motor of one or more internal combustion engines within an engine compartment and the energization of one or more exhaust blowers in ventilating fluid communication with the engine compartment. A central "guardian" unit houses the control circuits of the system and is adapted to be mounted on or near an instrument control panel having an ignition switch for starting the engine(s) within the engine compartment. The guardian is also connected to safety and warning indicator lights adapted to be mounted on the control panel. With the exception of output relays for switching larger currents, the control circuits within the guardian are comprised of digital circuits.

The digital circuits within the guardian are biased by a battery through the engine's ignition switch(s). The guardian circuits are inactive when the ignition switch(s) have continuously been in their OFF positions for at least three minutes. In this state, the starters and ignition coils of the engines within the engine compartment and the blower motor(s) are deenergized.

When any one of the ignition switches is positioned in its ON position, power is provided from the battery through that switch to the guardian control circuits. A "power-up" cycle is initiated within the guardian during which the logical circuits therein are cleared and an oscillator begins advancing a digital counter for a first three minute timing interval. The blower(s) are simultaneously energized to ventilate the engine compartment and the warning indicator light on the control panel is energized in a flashing mode. A blower sensing circuit detects actual activation of the blower(s) and provides an output signal which continually resets the counter if the blower is not activated, thus preventing the counter from advancing its count.

After the blower has been continually activated for the first three minute interval, a power hold circuit is activated and the circuit paths from the battery to the starter motor(s) and to the ignition coil(s) of the engine(s) are enabled. In this "ready" state, the warning light is energized in a steady state, the safety indicator light is energized, the blower continues to run, and an operator is enabled to start the engine(s).

If the ignition switch is thereafter returned to its OFF position, the counter is reset and begins advancing at 351 msec for a second three minute time interval during which time the power hold circuit will maintain the guardian in its "ready" state. Simultaneously, the blower will be maintained in its energized state for a minimum of 45 seconds.

If the ignition switch is subsequently repositioned in its ON position during the second three minute time interval, the blower will be continuously energized, the counter will be reset, and the guardian will resume its "ready" state indefinitely. This sequence of operations will be repeated if the ignition switch is repositioned to its OFF position.

If, however, the ignition switch is subsequently repositioned to its OFF position for a consecutive time period that exceeds the second three minute time interval, a complete recycling of the system is required.

If the engine is started when the guardian is in its "ready" state, the counter will be cleared and will begin advancing at a 351 msec rate for a third three minute time interval. The blower will continue to be energized until the expiration of the third three minute time interval as long as the engine is running. If the engine, after starting, is turned off within the third three minute time interval, the blower will remain energized thereafter for a minimum of 45 seconds.

An engine sensor monitors the flow of current pulses from the ignition coil to the distributor of the engine. A control circuit monitors the operative position of the ignition switch and the output signals from the engine sensor network and energizes the blower in response thereto whenever the ignition switch is positioned in its ON position and the engine sensor network indicates that the engine is not running.

Whenever the blower sensor network detects that the blower is not energized when enabled to do so, a general reset is produced within the guardian disabling the starter and ignition coil circuits of the engine(s), and the warning lamp is activated.

It is one object of the present invention, therefore, to provide a novel ignition safety control apparatus for internal combustion engines.

It is another object of the present invention to provide an ignition safety control apparatus that is adaptable for use with all internal combustion engines housed in an engine compartment susceptible of collecting explosive vapors.

It is a further object of the present invention to provide an ignition safety control system employing accurate and highly reliable solid state logic circuits.

It is a further object of the present invention, to provide an improved ignition safety control system that automatically enables the energization of engines housed in an engine compartment and blowers in fluid communication therewith according to logical sequences of predetermined events and time periods.

It is a further object of the present invention to provide an improved ignition safety control system that is responsive to the operative states of both the engines within an engine compartment and of the exhaust blowers in fluid communication therewith.

It is a further object of the present invention to provide an improved ignition safety control apparatus for power boats which will enable an operator to immediately start the boat's engine if its engine compartment has been previously properly ventilated even after the engine's ignition switch has been interveningly positioned in its OFF position.

These and other objects of my invention will become apparent to those skilled in the art upon consideration of the accompanying specification, claims and drawings.

DESCRIPTION OF THE PREFERRED EMBODIMENT

Figure 1:
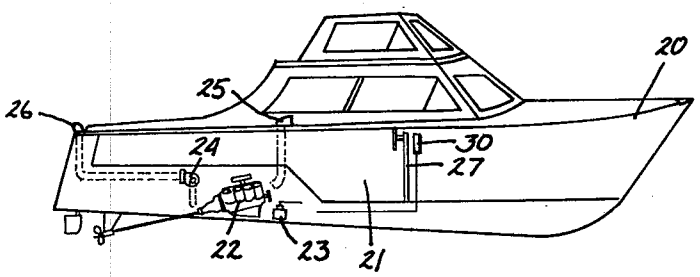
FIG. 1 is a pictorial diagram of a power boat employing the ignition safety control device of the present invention.

A preferred embodiment of the present invention as applied to the safety control of a boat's ignition system is illustrated in the Figures. Referring to the Figures, wherein like numerals represent like parts throughout the several views, there is generally shown in FIG. 1, a boat 20 having an engine compartment 21 housing one or more internal combustion engines 22, a bilge pump 23 and an electrical exhaust blower 24 for venting combustible fumes from the engine compartment 21. A fresh air intake vent 25 and an exhaust vent 26 are configured to cooperate in fluid communication with the exhaust blower 24 to provide ventilation of the engine compartment 21. The electrical blower is of explosion-proof construction or mounting such that when operative it will not produce sparks that could ignite explosive gases trapped within the engine compartment 21. A "guardian" unit 30 is shown positioned under a control panel 27 of the boat 20. The guardian 30 contains the control circuits of the safety control apparatus of the present invention.

Figure 2:
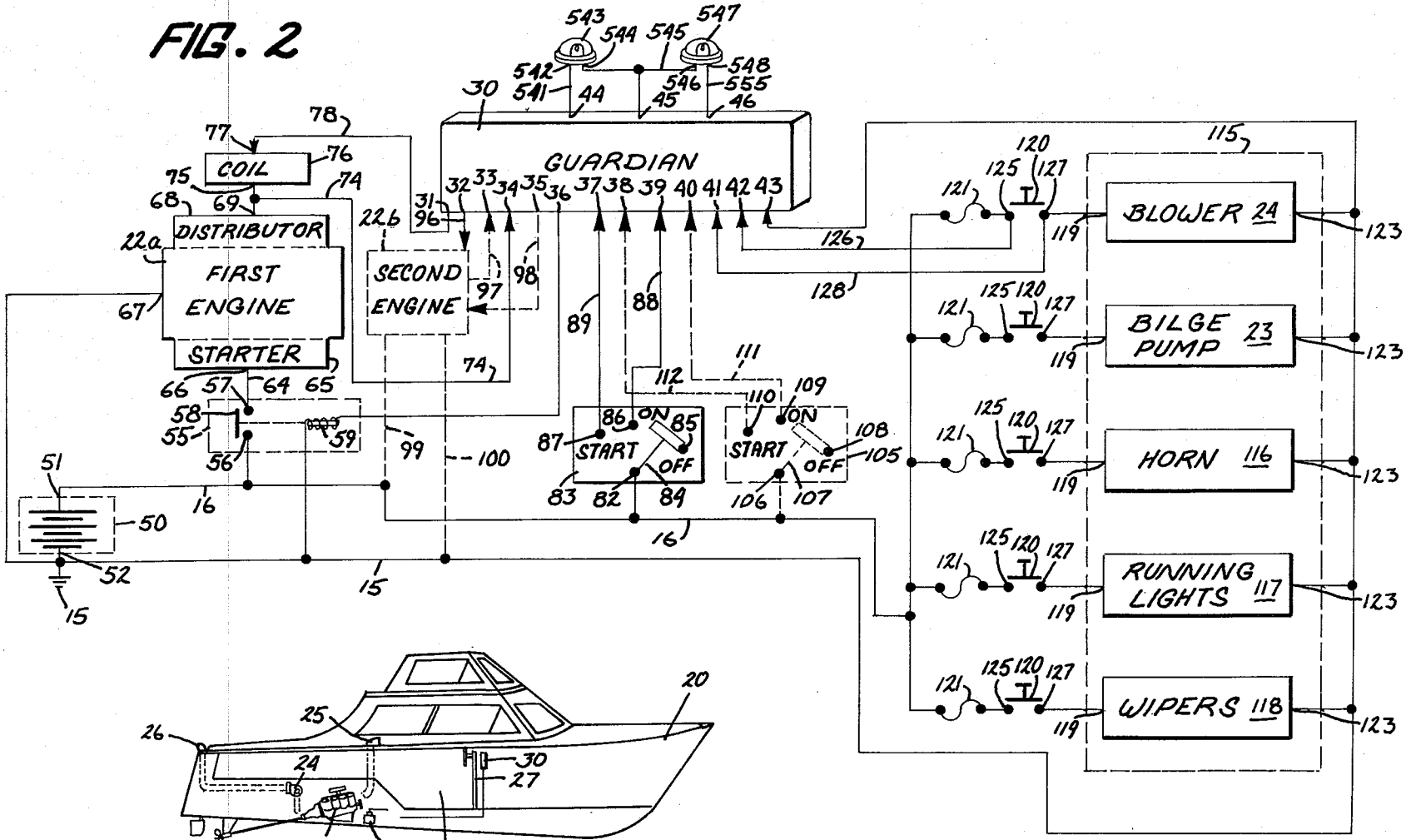
FIG. 2 is a block diagram representation of a power boat's electrical system employing the ignition safety control device of the present invention.

The guardian 30 is adapted to be readily mounted within the existing electrical system of most boats. FIG. 2 illustrates the guardian 30 as operatively connected within a typical electrical system of a power boat. Referring to FIG. 2, it will be recognized that the guardian 30 is illustrated in relation to its connection primarily to a first engine, and that its adoption for simultaneous connection to a second engine is illustrated by means of dashed lines.

Referring to FIG. 2, the guardian 30 generally has a plurality of input and output terminals designated as 31 through 46 respectively, each of which will be hereinafter described in more detail. A storage battery 50 having a positive terminal 51 and a negative terminal 52 maintains a 12 volt potential therebetween. The negative terminal 52 of the battery 50 is connected to an electrical ground (or negative bus) 15 of the electrical system of the boat 20.

The positive terminal 51 of the battery 50 is connected by means of a positive bus 16 to a first stationary contact 56 of a starter solenoid generally designated as 55. The starter solenoid further has a second stationary contact 57, a normally open movable contact 58 and an energizing coil 59. The energizing coil 59 of the solenoid 55 is directly connected between the output terminal 36 of the guardian 30 and the negative bus 15.

The second stationary contact 57 of the starter solenoid 55 is connected by means of a conductor 64 to an input 66 of an electrical starter motor 65. The starter motor 65 forms an integral part of a first engine **22(*a*). The first engine 22(*a*) further has a common electrical output designated as 67 directly connected to the negative bus 15, and also includes as an integral part thereof a distributor 68 which has an input terminal 69. The common output 67 of the engine 22(*a*) provides a ground return path for current flowing through the starter motor 65 and the distributor 68**.

The input 69 of the distributor 68 is connected by means of a conductor 74 to the input 34 of the guardian 30 and is further connected by means of the conductor 74 to a common terminal 75 of an ignition coil 76. The ignition coil 76 also has a positive terminal 77 connected by means of a conductor 78 to the output terminal 31 of the guardian 30.

It will be recognized that the battery 50, the starter solenoid 55, the starter motor 65, the first engine **22(*a*), the distributor 68 and the coil 76** with their associated interconnections generally form the heart of an electrical system of an internal combustion engine.

The positive terminal 51 of the battery 50 is also connected by means of the positive bus 16 to a common terminal 82 of a first ignition switch 83. The ignition switch 83 further has a movable wiper arm 84, a second stationary contact 85, a third stationary contact 86, and a fourth stationary contact 87. The second and third stationary contacts 85 and 86 of the ignition switch 83 are spaced sufficiently apart from one another such that the movable wiper arm 84 can contact only one of them at a time. When in a first (OFF) position the movable wiper arm 84 will provide an electrical connection between the common terminal 82 and the second stationary contact 85. When in a second (ON) position, the movable wiper arm 84 will provide electrical conduction between the common terminal 82 and the third stationary contact 86. The third and fourth stationary contacts 86 and 87 respectively are placed in proximity with one another such that the movable wiper arm 84 when positioned in a third (START) position will simultaneously contact the third stationary contact 86 and the fourth stationary contact 87 providing electrical conduction between these contacts and the common terminal 82.

The second stationary contact 85 is a deadend terminal. The third stationary contact 86 of the ignition switch 83 is connected by means of a conductor 88 to the input terminal 39 of the guardian 30. The fourth stationary contact 87 of the ignition switch 83 is connected by means of a conductor 89 to the input terminal 37 of the guardian 30.

The ignition switch 83 provides the physical mechanism for starting the first engine **22(*a*) and normally completes the electrical system of the internal combustion engine 22(*a*). In a standard electrical system (absent a guardian control unit 30), the fourth stationary contact 87 of the ignition switch 83 would be directly connected to the energizing coil 59 of the starter solenoid 55, and the third stationary contact 86 of the ignition switch 83 will be connected to the positive terminal 77 of the ignition coil 76. Therefore, the inclusion of the guardian 30 within the electrical system of the boat 20 has introduced an interruption in the normally closed electrical paths between stationary contacts 86 and 87 of the ignition switch 83 and the ignition coil 76 and starter solenoid 55** respectively.

As illustrated in FIG. 2, the guardian 30 is adapted to service a second internal combustion engine generally designated as 22(*b*) which is also located within the engine compartment 21. For the sake of brevity, the second engine 22(*b*), designated by dashed lines, is intended to represent and include an ignition coil, distributor, engine, starter, and starter solenoid (all not shown) analogous to those represented by numbers 76, 68, 22(*a*), 65 and 55 with respect to the first engine.

The output 32 of the guardian 30 is a functional dual of its output 31 and is connected by means of a conductor 96 to a positive side of an ignition coil (not shown) of the second engine 22(*b*). The input 33 of the guardian 30 is a functional dual of its input 34 and is connected by means of a conductor 97 to an output of an ignition coil and an input to a distributor (all not shown) of the second engine 22(*b*). The output 35 of the guardian 30 is a functional dual of its output 36 and is connected by means of a conductor 98 to an energizing coil (not shown) of a starter solenoid (not shown) of the second engine 22(*b*). The positive bus 16 and the negative bus 15 are connected to the electrical system of the second engine 22(*b*), analogously to the connections explained in detail with respect to the first engine 22(*a*), by means of a conductor 99 and a conductor 100 respectively.

A second ignition switch 105 controls the operative status of the second engine 22(*b*), and is identical in construction and operation to the first ignition switch 83 described with respect to the first engine 22(*a*). Specifically, the second ignition switch 105 has a common terminal 106 directly connected to the positive bus 16. The common terminal 106 has a movable wiper arm 107 attached thereto, and movable between a second stationary contact 108, a third stationary contact 109 and a fourth stationary contact 110. Positioning of the movable wiper arm 107 between OFF, ON, and START positions is identical as previously described with respect to the first ignition switch 83.

The third stationary contact 109 of the second ignition switch 105 is connected by means of a conductor 111 to the input 40 of the guardian 30 which functions as a dual of the input 39 of the guardian. The fourth stationary contact 110 of the second ignition switch 105 is connected by means of a conductor 112 to the input 38 of the guardian 30 which is an operational dual of input 37 of the guardian.

A plurality of electrical accessories, typically found on a power boat are generally designated in FIG. 1 at 115. Specifically there are shown the electrical exhaust blower 24, the bilge pump 23, a horn 116, a plurality of running lights generally designated as 117 and a windshield wiper motor 118. Each of the accessories 115 has a first input terminal generally designated as 119 connected by means of a normally open manual switch 120 in series with a fuse 121 to the positive bus 16. Each of the electrical accessories 115 further has a negative terminal 123 directly connected to the negative bus 15. The construction of the manual switches 120 is generally not important to this invention other than that each accessory 115 is energized by power from the battery 50 when its associated switch 120 is in a conducting mode (closed) and each accessory 115 is inoperative when its associated switch 120 is in a nonconducting (open) state.

The manual switch 120 associated with the electrical blower 24 has a first stationary contact 125 connected by means of a conductor 126 to the input terminal 42 of the guardian 30. Positive bias voltage from the positive bus 16 is provided to the guardian 30 by means of its input 42. The mechanical switch 120 associated with the electrical blower 24 further has a second stationary contact 127 connected by means of a conductor 129 to the input 41 of the guardian 30.

The negative bus 15 is directly connected to the input 43 of the guardian 30 and supplies a ground return path for the circuits contained therein.

Figure 3:
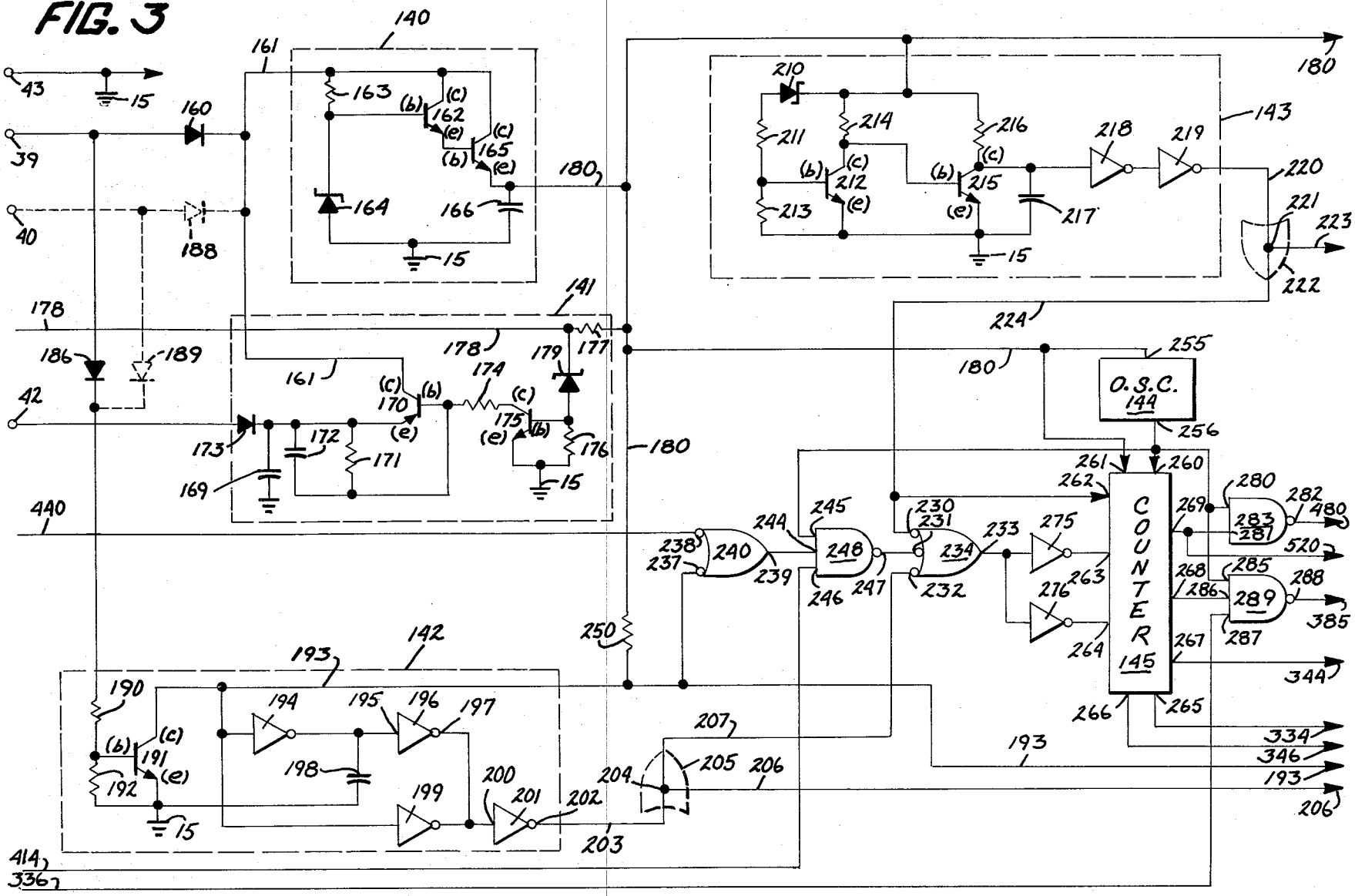
FIG. 3 is a schematic representation of a first portion of the guardian of the safety control device disclosed in FIG. 2.
Figure 4:
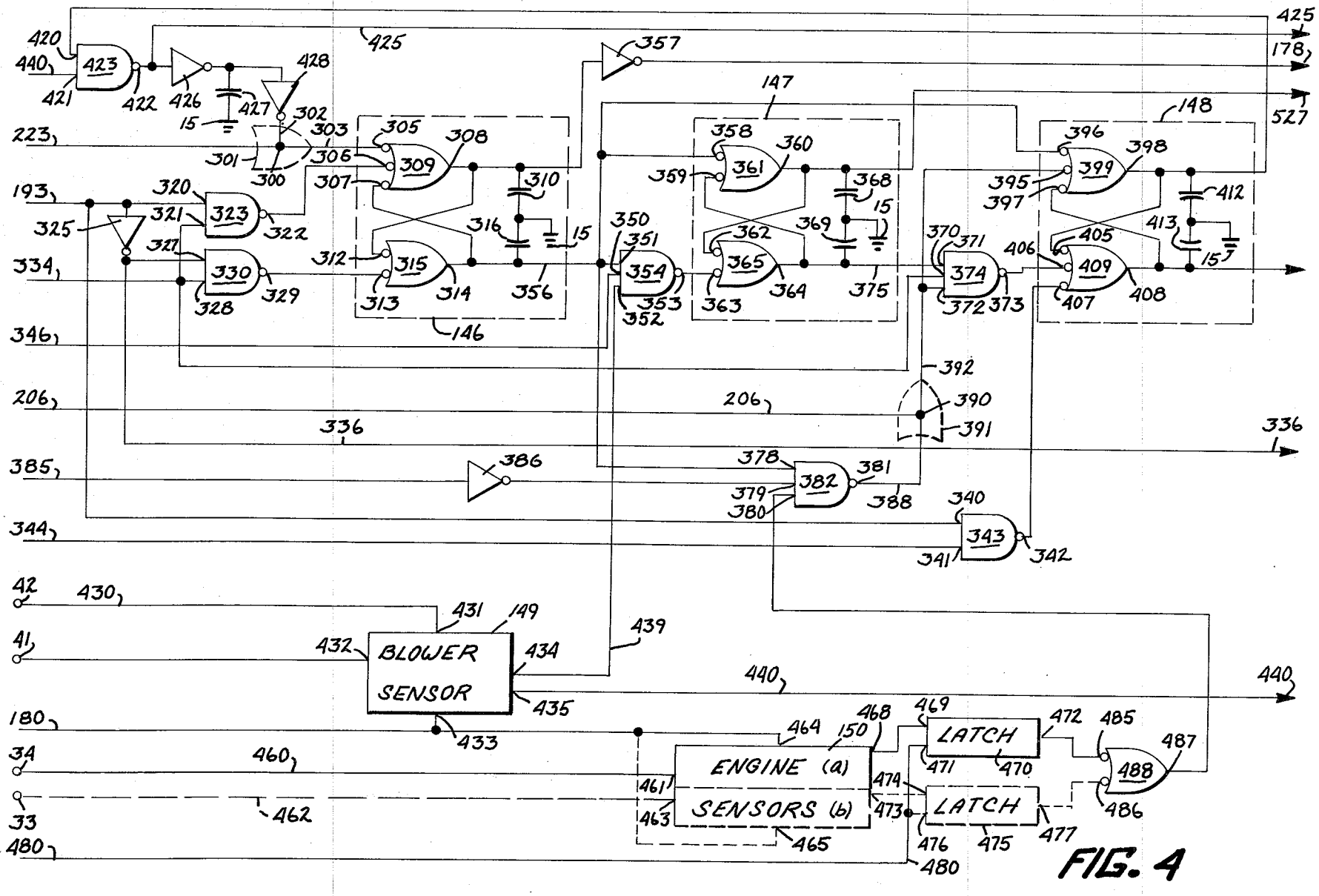
FIG. 4 is a schematic representation of a second portion of the guardian of the safety control device disclosed in FIG. 2.
Figure 7:
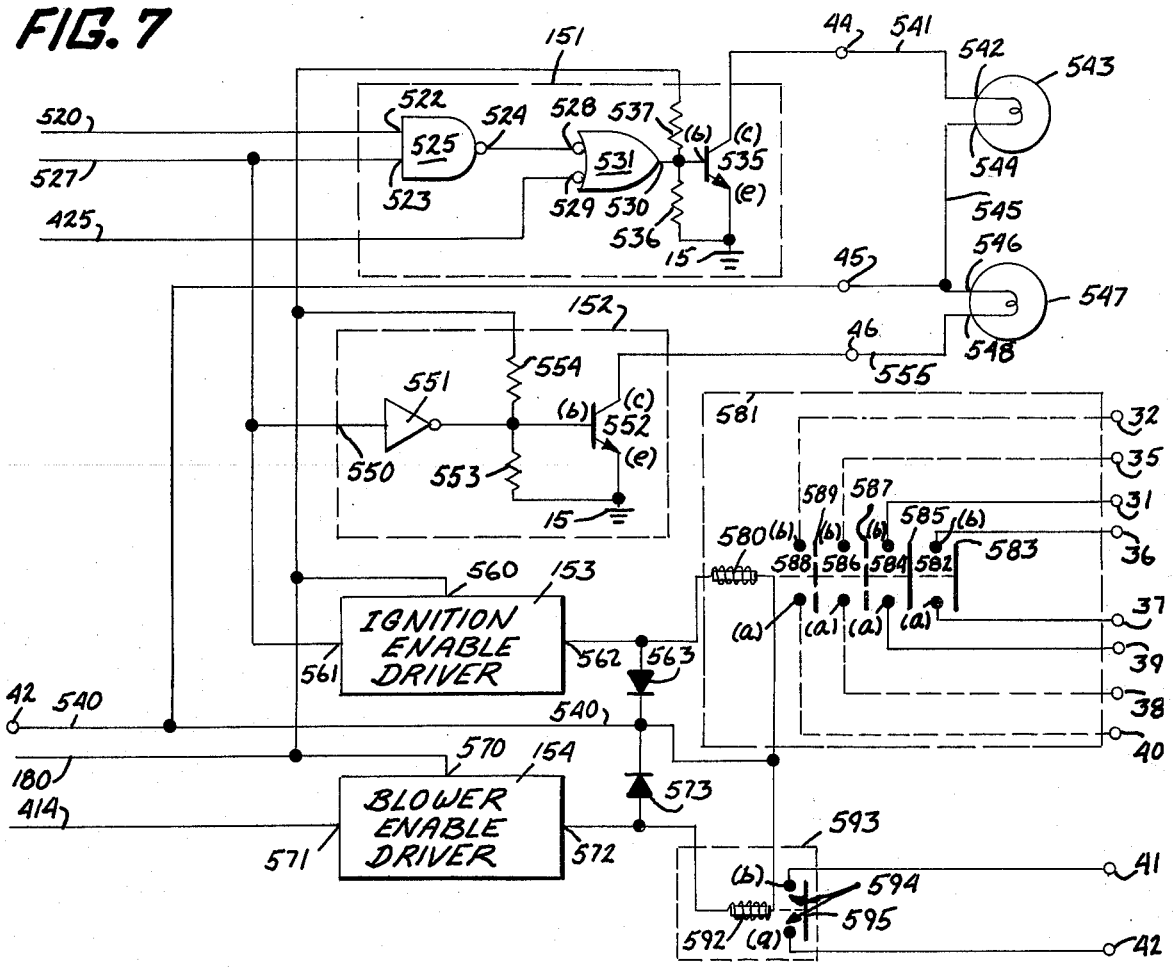
FIG. 7 is a schematic representation of the output driver circuits portion of the guardian of the safety control device disclosed in FIG. 2.

A preferred embodiment of the control circuits comprising the guardian 30 is collectively schematically illustrated in FIGS. 3, 4 and 7. Referring to FIG. 3, the input 43 of the guardian 30 forms the common or ground input (negative bus) 15 for the electrical circuits within the guardian. For the sake of clarity, connections to the common ground (negative bus) 15 will be represented by the standard three bar notation. Also, in describing standard logic gates throughout the schematic diagrams it will be understood that although not shown each logic gate contains a connection to a positive potential (as hereinafter described) and a connection to the common ground 15. Also, for the sake of clarity, transistors will be identified by a specific numeral designation, and the base, the emitter, and the collector thereof will respectively be designated by the notations (b), (e), and (c).

Referring collectively to FIGS. 3, 4 and 7, the major functional locks operatively combining to comprise the guardian 30 are: a power supply 140, a power hold circuit 141, a pulse generator circuit 142, a power clear circuit 143, an oscillator 144, a digital counter 145, a power latch circuit 146, a run latch circuit 147, a blower latch circuit 148, a blower sensor network 149 and an engine sensor network 150. The output drive circuits of the preferred embodiment generally include (FIG. 7) a warning indicator drive circuit 151, a safety indicator drive circuit 152, an ignition enable drive circuit 153 and a blower enable drive circuit 154.

Referring specifically to FIG. 3, the input 39 to the guardian 30 is connected by means of a diode 160 in series with a conductor 161 to a collector (c) of an NPN transistor 162. The transistor 162 further has a base (b) and an emitter (e). The base (b) of transistor 162 is connected by means of a bias resistor 163 to the conductor 161 and is further connected by means of a zener diode 164 to the common bus 15. The emitter (e) of transistor 162 is directly connected (in Darlington configuration) to a base (b) of an NPN transistor 165.

Transistor 165 further has a collector (*c*) directly connected to the conductor 161 and an emitter (*e*) connected by means of a capacitor 166 to the negative bus 15. The resistor 163, the zener diode 164, the transistors 162 and 165 and the capacitor 166 comprise the components of the power supply 140, with the conductor 161 forming the input thereto and the emitter (*e*) of transistor 165 forming its output.

The input 39 of the guardian 30 is also connected by means of the diode 160 and the conductor 161 to a collector (c) of a PNP transistor 170. Transistor 170 further has a base (b) and an emitter (*e*). The base (*b*) of transistor 170 is connected by means of a resistor 171 in parallel with a capacitor 172 to the emitter (*e*) of transistor 170. The emitter (e) of transistor 170 is further connected by means of a capacitor 169 to the common bus 15. The input of the guardian 30 is connected by means of a diode 173 to the emitter (*e*) of transistor 170.

The base (b) of transistor 170 is further connected by means of a resistor 174 to a collector (*c*) of a NPN transistor 175. Transistor 175 further has a base (*b*) connected by means of a resistor 176 to the common bus 15 and also has an emitter (*e*) directly connected to the common bus 15.

The emitter (*e*) of transistor 165 of the power supply 140 is connected by means of a power supply bus 180, in series with a resistor 177, a conductor 178 and a zener diode 179 to the base (*b*) of transistor 175. The transistors 170 and 175, the resistors 171, 174, 176 and 177, the capacitors 169 and 172, and the diodes 173 and 179 comprise the components of the power hold circuit 141. The power hold circuit 141 is powered from the input 42 of the guardian through the diode 173. The conductor 178 provides a logical signal input path to the hold circuit 141, and the conductor 161 provides a signal output path therefrom.

The input 39 of the guardian 30 is also connected by means of a diode 186 in series with a resistor 190 to a base (b) of an NPN transistor 191. Transistor 191 further has a collector (*c*) and an emitter (*e*) that is directly connected to the common bus 15. The base (*b*) of transistor 191 is also connected by means of a resistor 192 to the common bus 15.

The collector (*c*) of transistor 191 is connected by means of a conductor 193 in series with an inverter 194 to an input 195 of an inverter 196. The inverter 196 further has an output 197. The input 195 of inverter 196 is also connected by means of a capacitor 198 to the common bus 15. The collector (*c*) of transistor 191 is further connected by means of the conductor 193 in series with an inverter 199 to an input 200 of an inverter 201. The inverter 201 further has an output 202.

The output 197 of inverter 196 is directly connected to the input 200 of inverter 201. The output 202 of inverter 201 is connected by means of a conductor 203 to a junction point 204 of a hard-wired logical OR gate 205. A second conductor 206 and a third conductor 207 are also connected to the junction point 204.

The resistors 190 and 192, the transistor 191, the capacitor 198 and the inverters 194, 196, 199 and 201 comprise the components of the pulse generator circuit 142. The signal input path to the pulse generator 142 is provided through the resistor 190 and a first signal output of the pulse generator 142 is provided by means of the conductor 203. A second signal output is provided from the pulse generator circuit 142 by means of the conductor 193.

A dashed OR gate symbol enclosing a junction point (as illustrated with respect to numerals 204 and 205) will be employed throughout the specification to designate a hard-wired logical OR gate.

The input 40 of the guardian 30, when connected for operation with the second engine 22(*b*) (FIG. 2) is connected by means of a diode 188 to the conductor 161, thereby providing an input signal path to the power supply circuit 140.

The input 40 of the guardian 30 is further connected by means of a diode 189 in series with the resistor 190 to the base (*b*) of transistor 191 of the pulse generator circuit 142, thereby providing an input signal thereto. It will be noted that the diodes 188 and 189 respectively are the operative duals of the diodes 160 and 186 respectively.

The emitter (*e*) of transistor 165 within the power supply network 140 is also connected by means of the positive supply bus 180, in series with a zener diode 210 and a resistor 211 to a base (*b*) of an NPN transistor 212. The transistor 212 further has an emitter (*e*) directly connected to the common bus 15 and also has a collector (*c*). The base (*b*) of transistor 212 is also connected by means of a resistor 213 to the common bus 15.

The collector (*c*) of transistor 212 is connected by means of a resistor 214 to the positive supply bus 180 and is further directly connected to a base (*b*) of an NPN transistor 215. Transistor 215 further has an emitter (*e*) directly connected to the common bus 15 and also has a collector (*c*). The collector (*c*) of transistor 215 is connected by means of a resistor 216 to the positive supply bus 180 and by means of a capacitor 217 to the common bus 15.

The collector (*c*) of transistor 215 is also connected by means of a first inverter 218 in series with a second inverter 219 and a conductor 220 to a junction point 221 of a logical hard-wired OR gate 222. A second conductor 223 and a third conductor 224 are also connected to the junction point 221.

The resistors 211, 213, 214 and 216, the zener diode 210, the transistors 212 and 215, the capacitor 217 and the inverters 218 and 219 comprise the components of the power clear circuit 143. The positive supply bus 180 forms an input signal path to the power clear circuit 143, and the conductor 220 provides an output signal path from the power clear circuit 143.

The junction point 221 of the hard-wired logical OR gate 222 is connected by means of the conductor 224 to a first input 230 of a NAND gate 234. The NAND gate 234 further has a second input 231, a third input 232 and a signal output 233. The junction point 204 of the hard-wired logical OR gate 205 is connected by means of the conductor 207 to the third input 232 of the NAND gate 234.

The collector (*c*) of the transistor 191 within the pulse generator circuit 142, is further connected by means of the conductor 193 to a first input 237 of a NAND gate 240. The NAND gate 240 further has a second input 238 and a signal output 239. The output 239 of NAND gate 240 is directly connected to a first input 244 of a NAND gate 248. The NAND gate 248 further has a second input 245, a third input 246 and a signal output 247. The signal output 247 of the NAND gate 248 is directly connected to the second input 231 of the NAND gate 234.

A resistor 250 connects the positive supply bus 180 with the conductor 193. The positive supply bus 180 is also directly connected to a supply input 255 of the oscillator 144. The oscillator 144 further has a signal output 256 that is directly connected to the second input 245 of the NAND gate 248. The oscillator 144 may be of any standard construction which operates to produce a periodic oscillatory signal at its output 256. In the preferred embodiment, the oscillator 144 provides a periodic output signal at its output 256 which oscillates at a 351 msec rate.

The signal output 256 of the oscillator 144 is also directly connected to a signal input 260 of the counter 145. The counter 145 further has a bias input 261, a first reset input 262, a second reset input 263, a third reset input 264, a first three minute signal output 265, a second three minute signal output 266, a 45 second output 267, a first phase 702 msec clock output 268, and a second phase 702 msec clock output 269.

The counter 145 in the preferred embodiment is comprised of five dual J-K flip-flops (not shown) serially connected to provide a ten stage serial J-K flip-flop counter. The ten stages of the counter are connected to operate in a standard counting mode. The clock input of the first flip-flop is connected to the signal input 260 of the counter and is driven by an output signal from the oscillator 144. The output of the first stage is connected to the clock input of the second stage, and each succeeding stage is similarly serially connected. The clear input of the first stage J-K flip-flop is connected to the clear input 262 of the counter 145. The clear input of the second through sixth J-K flip-flop counter stages are connected to the clear input 263 of the counter 145. The clear inputs of the seventh through tenth J-K flip-flop counter stages are connected to the clear input 264 of the counter 145.

Each stage (flip-flop) of the counter necessarily has two outputs corresponding to the convention Q and $\overline{Q}$ outputs of a flip-flop. Although signal output connections may be made to both of the outputs of each stage of the counter 145, in the preferred embodiment, outputs are taken only from the first, eighth, and tenth stages. The Q and $\overline{Q}$ outputs of the tenth counter stage are connected respectively to the first and second three minute outputs 265 and 266 of the counter 145 and provide signal output levels of opposite logical states which switch after the counter has accumulated a count for three minutes following a master clear of each of the counter stages. An output of the eighth counter stage is connected to the 45 second signal output 267 of the counter 145 and provides a signal output which switches after a count has been accumulated in the counter 145 for 45 consecutive seconds following a master clear of the counter. Q and $\overline{Q}$ outputs of a first counter stage are connected respectively to the first and second phase 702 msec clock outputs 268 and 269 and provide output signals which logically switch out of phase with one another at a 702 msec clock rate.

A more detailed description of the operation of the counter 145 is hereinafter included in the section entitled "Operation of the Preferred Embodiment".

The bias input 261 of the counter 145 is directly connected to the positive supply bus 180. The junction point 221 of the hard-wired logical OR gate 222 is connected by means of the conductor 224 to the first reset input 262 of the counter 145.

The signal output 233 of the NAND gate 234 is connected by means of a first inverter 275 to the second reset input 263 of the counter 145 and is further connected by means of a second inverter 276 to the third reset input 264 of the counter 145.

The signal output 256 of the oscillator 144 is further directly connected to a first input 280 of a NAND gate 283. The NAND gate 283 further has a second input 281 that is directly connected to the output 269 of the counter 145 and also has a signal output 282.

The signal output 256 of the oscillator 144 is further directly connected to a first input 285 of a NAND gate 289. The NAND gate 289 also has a second input 286, a third input 287, and a signal output 288. The second input 286 of the NAND gate 289 is directly connected to the output 268 of the counter 145.

Referring to FIGS. 3 and 4, the junction point 221 of the hard-wired logical OR gate 222 is directly connected by means of the conductor 223 to a junction point 300 of a hard-wired logical OR gate 301. A second conductor 302 and a third conductor 303 are also connected to the junction point 300.

The junction point 300 of the hard-wired OR gate 301 is connected by means of the conductor 303 to a first input 305 of a NAND gate 309. The NAND gate 309 further has a second input 306, a third input 307 and a signal output 308. The signal output 308 of the NAND gate 309 is directly connected to a first input 312 of a NAND gate 315 and is also connected by means of a capacitor 310 to the common bus 15. The signal output 308 of the NAND gate 309 is also connected by means of an inverter 357 to the conductor 178.

The NAND gate 315 further has a second input 313 and a signal output 314. The signal output 314 of the NAND gate 315 is directly connected to the third input 307 of the NAND gate 309 and is also connected by means of a capacitor 316 to the common bus 15. The NAND gates 309 and 315 and the capacitors 310 and 316 comprise the elements of the power latch network 146.

The conductor 193 leading from the pulse generator circuit 142 is directly connected to a first input 320 of a NAND gate 323. The NAND gate 323 further has a second input 321 and a signal output 322. The signal output 322 of the NAND gate 323 is directly connected to the second input 306 of the NAND gate 309 of the pulse latch network 146.

The first input 320 of the NAND gate 323 is also connected by means of the conductor 193 and an inverter 325 to a first input 327 of a NAND gate 330. The NAND gate 330 further has a second input 328 and a signal output 329. The signal output 329 of NAND gate 330 is directly connected to the second input 313 of the NAND gate 315 within the pulse latch network 146.

The first three minute signal output 265 of the counter 145 is connected by means of a conductor 334 to the second inputs 321 and 328 respectively of the NAND gates 323 and 330.

The collector (*c*) of transistor 191 of the pulse generator circuit is also connected by means of the conductor 193, the inverter 325 and a conductor 336 to the third input 287 of the NAND gate 289, and is also connected by means of the conductor 193 to a first input 340 of a NAND gate 343. The NAND gate 343 further has a second input 341 and a signal output 342.

The 45 second signal output 267 of the counter 145 is directly connected by means of a conductor 344 to the second input 341 of the NAND gate 343.

The second three minute signal output 266 of the counter 145 is directly connected by means of a conductor 346 to a first input 350 of a NAND gate 354. The NAND gate 354 further has a second input 351, a third input 352 and a signal output 353.

The output 314 of the NAND gate 315 within the power latch network 146 is directly connected by means of a conductor 356 to the second input 351 of the NAND gate 354 and is also directly connected to a first input 358 of a NAND gate 361. The NAND gate 361 further has a second input 359 and a signal output 360 which is directly connected to a first input 362 of a NAND gate 365.

The NAND gate 365 further has a second input 363 and a signal output 364 that is directly connected to the second input 359 of NAND gate 361. The signal output 353 of NAND gate 354 is directly connected to the second input 363 of NAND gate 365. The signal outputs 360 and 364 respectively of NAND gates 361 and 365 are connected respectively by means of a capacitor 368 and a capacitor 369 to the common bus 15. The NAND gates 361 and 365 and the capacitors 368 and 369 form the elements of the run latch network 147.

The first three minute signal output 365 of the counter 145 is also directly connected by means of the conductor 334 to a first input 370 of a NAND gate 374. The NAND gate 374 further has a second input 371, a third input 372, and a signal output 373. The signal output 364 of the NAND gate 365 of the run latch network 147 is directly connected by means of a conductor 375 to the second input 371 of NAND gate 374.

The output 314 of the NAND gate 315 within the power latch network 146 is further connected by means of the conductor 356 to a first input 378 of a NAND gate 382. The NAND gate 382 further has a second input 379, a third input 380 and a signal output 381. The output 288 of the NAND gate 289 (FIG. 3) is directly connected by means of a conductor 385 and an inverter 386 to the second input 379 of the NAND gate 382.

The signal output 381 of the NAND gate 382 is directly connected by means of a conductor 399 to a junction point 390 of a hard-wired logical OR gate 391.

The junction 204 of the logical hard-wired OR gate 205 (FIG. 3) is directly connected by means of the conductor 206 to the junction point 390 of the hard-wired OR gate 391. The junction point 390 of the hard-wired OR gate 391 is also directly connected by means of a conductor 392 to the third input 372 of the NAND gate 374 and is also directly connected by means of the conductor 392 to a first input 395 of a NAND gate 399. The NAND gate 399 further has a second input 396, a third input 397 and a signal output 398. The output 314 of the NAND gate 315 within the power latch network 146 is directly connected by means of the conductor 356 to the second input 396 of the NAND gate 399.

The output 398 of the NAND gate 399 is directly connected to a first input 405 of a NAND gate 409. The NAND gate 409 further has a second input 406, a third input 407 and a signal output 408.

The output 371 of NAND gate 374 is directly connected to the second input 406 of the NAND gate 409. The signal output 342 of the NAND gate 343 is directly connected to the third input 407 of the NAND gate 409. The signal output 408 of the NAND gate 409 is directly connected to the third input 397 of the NAND gate 399. The outputs 398 and 408 of the NAND gates 399 and 409 respectively are respectively connected by means of a capacitor 412 and a capacitor 413 to the common bus 15.

The NAND gates 399 and 409 and the capacitors 412 and 413 as interconnected comprise the elements of the blower latch network 148.

The signal output 398 of the NAND gate 399 of the blower latch network 148 is directly connected to a first input 420 of a NAND gate 423. The NAND gate 23 further has a second input 421 and a signal output 422. The signal output 422 of the NAND gate 423 is connected by means of a conductor 425 in series with an inverter 426 and a capacitor 427 to the common bus 15, and is also connected by means of the conductor 425 in series with the inverter 426 and an inverter 428 and the conductor 302 to the junction point 300 of the hard-wired OR gate 301.

The input 42 of the guardian 30 is directly connected by means of a conductor 430 to a first input 431 of the blower sensor network 149. The input 42 of the guardian further provides a bias signal from the battery as hereinafter described to the output drive circuits illustrated in FIG. 7. The blower sensor network further has a second input 432, a bias input 433, a first output 434 and a second output 435. The positive potential bus 180 (FIG. 3) is directly connected to the bias input 433 of the blower sensor network 149.

The input 41 of the guardian 30 is directly connected by means of a conductor 438 to the second input 432 of the blower sensor network 149. The first output 434 of the blower sensor network 149 is directly connected by means of a conductor 439 to the third input 352 of the NAND gate 354. The second signal output 435 of the blower sensor network 149 is directly connected by means of a conductor 440 to the second input 238 of the NAND gate 240 (FIG. 3), and is also directly connected by means of the conductor 440 to the second input 421 of the NAND gate 423 (FIG. 4).

Figure 6:
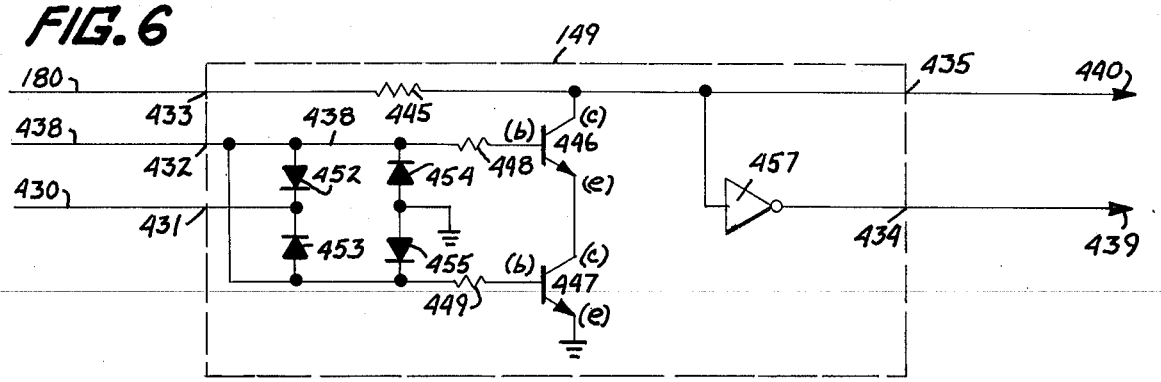
FIG. 6 is a detailed schematic representation of the blower sensor network disclosed in FIG. 4.

A more detailed description of the blower sensor network 149 is schematically illustrated in FIG. 6. Referring to FIG. 6, the bias input 433 of the blower sensor network 149 is connected by means of a resistor 445 to a collector (*c*) of an NPN transistor 446. The transistor 446 further has a base (*b*) and an emitter (*e*) which is directly connected to a collector (*c*) of an NPN transistor 447.

The transistor 447 further has a base (*b*) and an emitter (*e*) which is directly connected to the common bus 15.

The second input terminal 432 of the blower detector network 149 is directly connected by means of the conductor 438 and a resistor 449 to the base (*b*) of transistor 446, and is also directly connected by means of the conductor 438 in series with a resistor 449 to the base (*b*) of the transistor 447. A pair of diodes 452 and 453 are connected in parallel between the second and first input terminals 432 and 431 respectively of the blower sensor network 149. A pair of diodes 454 and 455 are connected in parallel between the common bus 15 and the second input terminal 432 of the blower sensor network 149.

The collector (*c*) of the transistor 446 is directly connected to the second output terminal 435 of the blower sensor network 149 and is also connected by means of an inverter 457 to the first output 434 of the blower sensor network 149.

Referring to FIG. 4 the input 34 of the guardian 30 is directly connected by means of a conductor 460 to a first input terminal 461 of the symmetrical engine sensor network 150. The engine sensor network 150 is comprised of two identical sensing networks generally designated in FIG. 4 as "*a*" and "*b*". The "*b*" section of the engine sensor network 150 is illustrated by dashed lines since, as hereinafter described, its use is only required where the second engine 22(*b*) is operatively present in the engine compartment 21 of the boat 20 (FIGS. 1 and 2). The engine sensor network 150 further has a second input 463, a first bias input 464, a second bias input 465, a first output 468, and a second output 473.

The input 33 of the guardian 30 is directly connected by means of a conductor 462 to the second input 463 of the engine sensor network 150. It will be noted that the first and second inputs 461 and 463 respectively of the engine sensor 150 provide dual input functions for the "*a*" and "*b*" sections respectively of the engine sensor network 150.

The positive supply bus 180 is directly connected to the first and second bias inputs 464 and 465 respectively of the engine sensor network 150, each providing a dual function for their respective halves of the network. The first output 468 of the engine sensor network 150 is directly connected to a first input 469 of a latch network 470. The latch network 470 further has a second input 471 and a signal output 472.

The second output 473 of the engine sensor network 150 is directly connected to a first input 474 of a latch network 475. The latch network 475 further has a second input 476 and a signal output 477.

The signal output 282 of the NAND gate 283 (FIG. 3) is directly connected by means of a conductor 480 to the second inputs 471 and 476 respectively of the latch networks 470 and 475.

The signal output 472 of the latch network 473 is directly connected to a first input 485 of a NAND gate 488. The NAND gate 488 further has a second input 486 and a signal output 487. The signal output 477 of the latch network 475 is directly connected to the second input 486 of the NAND gate 488. The signal output 487 of the NAND gate 488 is directly connected to the third input 380 of the NAND gate 382.

Figure 5:
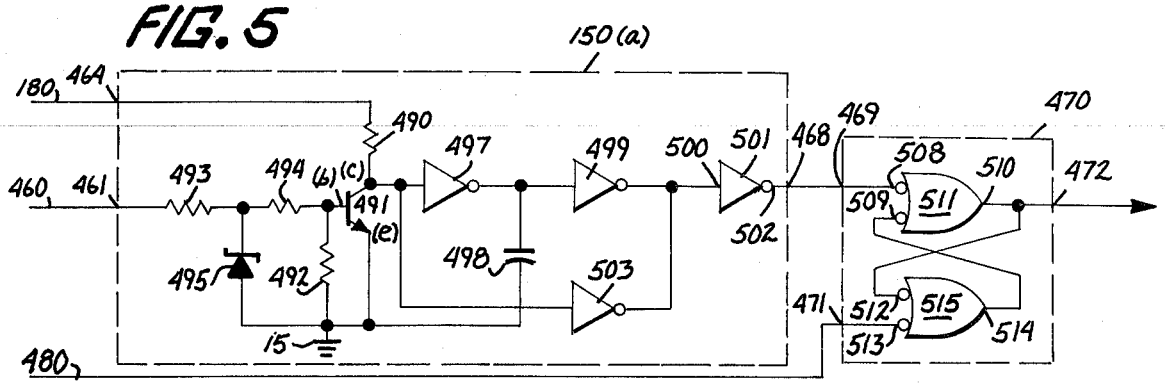
FIG. 5 is a detailed schematic representation of the engine sensor networks disclosed in FIG. 4.

A more detailed schematic diagram representing each of the dual halves of the engine sensor "*a*" and "*b*" circuits 150 of FIG. 4 and their output latch circuits is illustrated in FIG. 5. Referring to FIG. 5, the circuit illustrated will be described with reference to only the "*a*" portion of the engine sensor network, it being understood that the network is identical in construction and function for the "*b*" portion of the engine sensor network 150.

The first bias input 464 is directly connected by means of the positive supply bias 190 and a bias resistor 490 to a collector (*c*) of an NPN transistor 491. The transistor 491 further has a base (*b*) and an emitter (*e*) that is directly connected to the common bus 15. The base (*b*) of the transistor 491 is connected by means of a bias resistor 492 to the common bus 15.

The first input 461 of the engine sensor network 150 is connected by means of the conductor 460 in series with a resistor 493 and a resistor 494 to the base (*b*) of the transistor 491. The first input 461 is also connected by means of the conductor 460, the resistor 493 and a zener diode 495 to the common bus 15.

The collector (*c*) of the transistor 491 is connected by means of an inverter 497 and a capacitor 498 to the common bus 15. The collector (*c*) of transistor 491 is also connected by means of the inverter 497 in series with an inverter 499 to an input 500 of an inverter 501, and is further connected by means of an inverter 503 to the input 500 of the inverter 501. The inverter 501 further has an output 502 directly connected to the first signal output 468 of the engine sensor network 150(*a*).

The output 502 of the inverter 501 is directly connected to a first input 508 of a NAND gate 511 within the latch network 470. The NAND gate 511 further has a second input 509 and a signal output 510 that is directly connected to a first input 512 of a NAND gate 515.

The NAND gate 515 further has a second input 513 and a signal output 514 directly connected to the second input 509 of the NAND gate 511. The signal output 510 of the NAND gate 511 is directly connected to the signal output 472 of the latch network 470.

The second input 471 of the latch network 470 is directly connected to the second input 514 of the NAND gate 515.

The second phase 702 msec clock output 269 of the counter 145 (FIG. 3) is also directly connected by means of a conductor 520 to (FIG. 7) a first input 522 of a NAND gate 525. The NAND gate 525 further has a second input 523 and a signal output 524. The signal output 360 (FIG. 4) of the NAND gate 361 of the run latch network 147 is directly connected by means of a conductor 527 to the second input 523 of the NAND gate 525.

The output 524 of the NAND gate 525 is directly connected to a first input 528 of a NAND gate 531. The NAND gate 531 further has a second input 529 and a signal output 530. The output 422 of the NAND gate 423 (FIG. 4) is also directly connected by means of the conductor 425 to the second input 529 of the NAND gate 531.

The output 530 of the NAND gate 531 is directly connected to a base (*b*) of a transistor 535. The transistor 535 further has a collector (*c*) and an emitter (*e*) which is directly connected to the common bus 15. The base (*b*) of transistor 535 is connected by means of a resistor 536 to the common bus 15.

The positive supply bus 180 is connected by means of a resistor 537 to the base (*b*) of transistor 535. The collector (*c*) of the transistor 535 is directly connected to the output terminal 44 of the guardian 30 (see FIGS. 7 and 2). The NAND gates 525 and 531, the resistors 536 and 537 and the transistor 535 comprise the components of the warning indicator drive circuit 151.

Referring to FIG. 7, the input terminal 42 of the guardian 30 is directly connected by means of a conductor 540 to the output terminal 45 of the guardian and provides a 12 volt bias from the battery 50 (FIG. 2) thereto. The output terminal 44 of the guardian is directly connected by means of a conductor 541 to a first terminal 542 of a warning indicator light 543. The warning indicator light 543 further has a second terminal 544. The output terminal 45 of the guardian 30 is directly connected by means of a conductor 545 to the second terminal 544 of the warning indicator light 543.

The output terminal 45 of the guardian 30 is further directly connected by means of the conductor 545 to a first terminal 546 of a safety indicator light 547. The safety indicator light 547 further has a second terminal 548.

The output 360 of the NAND gate 361 is also directly connected by means of the conductor 527 to an input 550 of the safety indicator drive circuit 152. The input 550 of the safety indicator drive circuit 152 is directly connected by means of the conductor 527 in series with an inverter 551 to a base (*b*) of an NPN transistor 552. The transistor 552 further has a collector (*c*) and an emitter (*e*) which is directly connected to the common bus 15. The base (*b*) of transistor 552 is also connected by means of a resistor 553 to the common bus 15. The positive supply bus 180 is connected by means of a resistor 554 to the base (*b*) of the transistor 552.

The collector (*c*) of the transistor 552 is directly connected to the output 46 of the guardian 30. The output 46 of the guardian 30 is directly connected by means of a conductor 555 to the second terminal 548 of the safety indicator light 547.

The inverter 551, the resistors 553 and 554 and the transistor 552 comprise the components of the safety indicator drive circuit 152.

The positive supply bus 180 is also directly connected to an input terminal 560 (FIG. 7) of the ignition enable drive circuit 153. The ignition enable drive circuit 153 further has a second input 561 and a signal output 562. The output 360 of the NAND gate 361 (FIG. 4) is further directly connected by means of the conductor 527 to the second input 561 of the ignition enable drive circuit 153. The signal output 562 of the drive circuit 153 is connected by means of a diode 563 to the conductor 540. The components comprising the ignition enable drive circuit 153 are identical in construction and function with those illustrated with respect to the safety indicator drive circuit 152.

The positive supply bus 180 is also directly connected to a bias input 570 of the blower enable drive circuit 154. The blower enable drive circuit 154 further has a signal input 571 and a signal output 572. The output 408 of the NAND gate 409 within the blower latch network 148 (FIG. 4) is directly connected by means of a conductor 414 to the signal input 571 of the blower enable drive circuit 154. The signal output 572 of the blower enable drive circuit 154 is connected by means of a diode 573 to the conductor 540. The components comprising the blower enable drive circuit 154 is identical in structure and function to that of the safety indicator drive circuit 152 previously described. The signal output 408 of the NAND gate 409 (FIG. 4) is also directly connected by means of the conductor 414 to the third input 246 of the NAND gate 248 (FIG. 3).

The signal output 562 of the ignition enable drive circuit 153 is further directly connected by means of an ignition enable energizing coil 580 of a four contact relay 581 to the conductor 540. The relay 581 further has a first pair of contacts 582(*a*) and 582(*b*) respectively directly connected to the input 37 and the output 36 of the guardian 30. A movable contact 583 cooperates with the pair of stationary contacts 582 and is held in a normally open position when the coil 580 is not energized. A second pair of stationary contacts 584(*a*) and 584(*b*) are respectively directly connected to the input 39 and the output 31 of the guardian 30. A movable contact 585 cooperates with the pair of stationary contacts 584 and is held in a normally open position when the coil 580 is not energized. A third pair of stationary contacts 586(*a*) and 586(*b*) are respectively directly connected to the input 38 and the output 35 of the guardian 30. A movable contact 587 cooperates with the pair of stationary contacts 586 and is held in a normally open position when the coil 580 is not energized. A fourth pair of stationary contacts 588(*a*) and 588(*b*) are respectively directly connected to the input 40 and the output 32 of the guardian 30. A movable contact 589 cooperates with the pair of stationary contacts 588 and is held in a normally open position when the coil 580 is not energized. The movable contacts 583, 585, 587 and 589 of the relay 581 are positioned in proximity with their respective stationary contact pairs so as to simultaneously close their respective circuits when the coil 580 is energized.

The signal output 572 of the blower enable driver circuit 154 is also directly connected by means of a blower enable energizing coil 592 of a single contact pair relay 593 to the conductor 540. The relay 593 also has a pair of contacts 594(*a*) and 594(*b*) which are respectively directly connected to the input 42 and the output 41 of the guardian 30. A movable contact 595 cooperates with the pair of stationary contacts 594 and is held in a normally open position when the coil 592 is not energized. When the coil 592 is energized the movable contact 595 moves to engage the pair of stationary contacts 594 thus closing the electrical circuit therebetween.

Operation of the Preferred Embodiment

General System Control Functions

As illustrated in FIGS. 1 and 2, the guardian 30 comprises the logic and control elements of the ignition safety control system. The guardian 30 is sized for ease of mounting under or behind the control panel of the boat in which it is mounted; and the wires leading to and from inputs and outputs of the guardian 30 may be sheathed so as to provide a single path from the mounted guardian 30 to the engine compartment 21 of the boat.

The guardian 30 of the preferred embodiment may be employed to control the electrical energization of first and second engines 22(*a*) and 22(*b*) within the engine compartment 21. The second engine 22(*b*), its ignition switch 105 and its associated interconnecting conductors have been illustrated by dashed lines (FIG. 2) so that the system operation can be described with reference to a single engine (the first engine 22(*a*); it being understood that the system operation with respect to the second engine 22(*b*) is a dual thereof.

In general, the guardian 30 interrupts and directly controls the flow of current from the positive terminal 51 of the battery 50 through the first ignition switch 83, when its wiper arm 84 is positioned in its ON or START positions, to the coil 76 of the engine 22(*a*). Referring to FIG. 7, it will be noted that this direct current flow interruption is provided by the stationary contacts 584 and the movable contact 585 of the relay 581.

The guardian 30 also interrupts and controls the flow of current from the battery to the starter motor 65. The first pair of stationary contacts 582 of the relay 581 and the movable contacts 583 associated therewith operate to interrupt (and control) the flow of current through the ignition switch 83, when its movable wiper arm 84 is positioned in its START position, to the energizing coil 59 (FIG. 2) of the starter solenoid 55. Since the energizing coil 59 of the starter solenoid 55 controls the movement of the movable contact 58 in relation to the first and second stationary contacts 56 and 57 of the starter solenoid, the guardian 30 acts to indirectly control the flow of current from the positive bus 16 to the starter motor 65. It will be recognized that the starter motor 65 is energized, causing the engine 22(*a*) to "turnover", whenever the electrical circuit is closed between its first and second stationary contacts 56 or 57 respectively by means of the movable contact 58. It will be noted that the direct signal path established from the battery 50 through the starter solenoid 55 to the starter 65 enables large current signals to flow therebetween when the movable contact 58 closes the starter solenoid circuit. The negative bus 15 connected to the common output 67 of the engine 22(*a*) provides a signal flow return path to the negative terminal 52 of the battery 50 for currents supplied by the battery to the starter motor 65 and to the coil 76 and distributor 68.

The guardian 30 also directly controls the flow of current from the battery 50 by means of the positive bus 16 to the blower motor 24 by means of the relay 593 (FIG. 7). Referring to FIGS. 2 and 7, it will be noted that the pair of stationary contacts 594(*a*) and 594(*b*) are respectively connected directly in parallel with the first and second stationary contacts 125 and 127 of the switch 120 leading to the blower motor 24. Therefore, the blower motor 24 may be energized by the battery either under operator control by a closing of the manually operated switch 120 leading to the blower motor 24, or automatically, under control of the guardian 30, by means of the relay 593.

The remaining electrical accessories 115, as illustrated in the preferred embodiment, may be directly operated from the battery 50 only under operator control by means of the manual switches 120 associated with the respective electrical accessories.

The electrical control circuits within the guardian 30, collectively illustrated in FIGS. 3, 4 and 7, provide the control signals to the energizing coils 580 and 592 of the relays 581 and 593 (FIG. 7) for controlling the current flow to the engine 22(*a*) and to the blower 24. A twelve volt potential from the battery 50 is made available to certain circuits within the guardian 30 by means of the signal flow path consisting of the positive bus 16, the first stationary contact 125, of the blower switch 120, the conductor 126 and the input terminal 42 of the guardian 30 (FIG. 2). A ground return path is provided for electrical circuits within the guardian 30 by means of the signal flow path established by the signal output 43 and the negative bus 15 to the negative terminal 52 of the battery 50.

Specific Logic and Control Elements

It should be noted that all transistors of logic and control circuits within the guardian 30 operate in the switching mode (i.e. - either in saturation or in cutoff).

Referring to FIG. 3, the power supply 140 is generally operative to provide at the emitter (*e*) of transistor 165 a constant potential, whenever a voltage signal of greater than six volts is applied to he conductor 161. Under these conditions the zener diode 164 will clamp the voltage at the base (*b*) of transistor 162 at 6 volts and the transistors 162 and 165 will be driven into saturation providing a constant five volt potential on the power supply bias 180.

The five volt bias potential applied by the power supply to the power supply bus 180 is employed to power the logic gates and circuits within the guardian 30. A positive potential may be supplied to conductor 161 through the input 39 of the guardian leading to the third stationary contact 86 (ON position) of the ignition switch 83. A positive potential may also be applied to conductor 161 by means of the collector (*c*) of transistor 170 of the hold network 141 when transistor 170 is conducting in its saturated mode.

The power hold network 141 generally operates in response to the logical status of the signal applied to its input conductor 178. When the signal appearing on conductor 178 is at a logical low level the NPN transistor 175 will be biased in its cutoff mode and will not supply a base return path for the PNP transistor 170, thereby causing transistor 170 also to operate in its cutoff mode. The voltage, therefore, appearing on conductor 161 will be determined solely by the signal applied thereto from the input terminal 39 of the guardian 30. When a logical high signal appears on conductor 178 sufficient to break over the zener diode 179 (3 volts), transistor 175 will be biased into saturation, providing an electrical conduction path for the base (*b*) of transistor 170, thereby enabling transistor 170 to be driven into saturation.

Since the input 42 of the guardian 30 is externally connected to the positive bus 16, the voltage that will appear on conductor 161 when transistor 170 is saturated will be approximately 12 volts minus the forward diode drop of diode 173 and the $V_{CE(Sat)}$ voltage of transistor 170. Since the reverse breakdown voltage of the zener diode 179 is three volts, the five volt potential appearing on the power supply bus 180 when the power supply 140 is operating would normally (in the absence of a logical low level on conductor 178) be sufficient to drive the transistors 175 and 170 into saturation. Therefore, the operative state of the power hold circuit 141 is entirely dependant upon the logical level of on conductor 178. The logical level of conductor 178 depends upon the set state of the power latch network 146 as hereinafter described.

The pulse generator 142 (FIG. 3) under steady state conditions (i.e. an unvarying signal is applied by means of the resistor 190 to the base (*b*) of transistor 191) will provide a logical high output signal on the conductor 203 regardless of the logical level of the signal applied to the base (*b*) of transistor 191. This result is readily obtained by observing that there will always be a logical low voltage level appearing at the input 200 of the inverter 201, under steady state input conditions. If a logical high level concurrently appears at the input 200 of inverter 201, it is well known that the logical low level will dominate the logical high, due to the saturated output transistor of the inverter that produces the logical low.

The pulse generator 142 generally operates in response to a change in the signal level applied to the base (*b*) of transistor 191 from a logical low to a logical high. The pulse generator responds to such level change to produce a negative going pulse of approximately 100 msec in width at the output 202 of the inverter 201 as follows. When an abrupt positive signal is applied by means of the resistor 190 to the base (*b*) of the transistor 191 sufficient to drive transistor 191 into saturation a virtual ground will appear on the conductor 193. As a result, the input 200 of inverter 201 will immediately appear at a logical high as a result of the inversion by inverter 199, causing the signal level on conductor 203 to appear at a logical low. Simultaneously, the capacitor 198 will begin charging through the inverter 194 at a given time constant dependent upon the value of capacitor 198 and the bias resistors included within the inverters 194 and 196 until the voltage appearing at the input 195 of inverter 196 is sufficient to drive inverter 196 into its logical low output state. In the preferred embodiment this time interval is approximately 100 msec. When a logical low level appears at the output 197 of inverter 196, the logical high output of inverter 199 will be dominated thereby, causing the inverter 201 to switch back to its steady state mode, and providing a logical high level on the conductor 203.

Although a particular configuration of a pulse generator 142 has been illustrated, it will be recognized that any pulse generator configuration could be employed whose output characteristics are identical to those just described.

Upon the application of a bias potential on the power supply bus 180, the power clear network 143 generally functions to provide a logical low output pulse of long duration to the conductor 220 for clearing the logical circuits within the guardian 30. When the power supply bus 180 is energized to a five volt potential, the transistor 215 of the power clear network 143 is immediately driven into saturation causing a logical low to appear at its collector (*c*). The logical low on the collector (*c*) of transistor 215 will be reflected on conductor 220 by means of the double inversion provided by the inverters 218 and 219. Simultaneously, the transistor 212 will be biased in its cutoff region until the potential on the power supply bus 180 exceeds the three volt zener breakdown voltage of zener diode 210. At that voltage, conduction will occur through the zener diode 210 and the resistor 211 to the base (*b*) of transistor 212; a further increase in the potential in the power supply bus 180 will drive transistor 212 into saturation. When transistor 212 saturates, the voltage at its collector (*c*) will appear at a logical low, thereby pulling transistor 215 out of saturation and into cutoff, and causing a logical high to appear at the collector (*c*) of transistor 215. The logical high at the collector (*c*) of transistor 215 will be reflected on conductor 220 by means of the inverters 218 and 219 delayed in time by the charging rate of the capacitor 217. The resultant signal appearing on conductor 220 will be a single negative going pulse of approximately 1 msec duration at the logical low level.

It will be noted that the power clear circuit 143 will only produce a pulse upon initial power-up of the guardian 30 resulting from a deenergization and succeeding energization of the power supply 140. Under steady state conditions, when the power supply 140 is energized, the signal level appearing on conductor 220 will remain at a logical high.

It will also be recognized that the invention is not limited to the use of the particular circuitry illustrated for implementing the power clear circuit but that any equivalent circuit configuration which performs a like function may be employed.

The oscillator 144 and the counter 145 in combination provide the significant timing functions within the guardian 30. The oscillator 144 may be of any configuration which functions to produce a continuous periodic oscillatory output signal. In the preferred embodiment, the oscillator 144 receives its bias potential from the positive power supply bus 180 and produces a signal at its output 256 which varies at a 351 msec rate. The oscillatory signal at the oscillator output 256 directly drives the first stage of counter 145 (as previously described) through the input 260 of the counter.

The ten stage serially connected J-K flip-flop counter 145 operates in a standard counting mode with the clock input 260 of the first counter stage being driven at a 351 msec rate by the oscillator 144. The outputs of each stage of the counter switch at a frequency one-half that of the frequency of the input signal driving that stage. For example, the output of the first counter stage switches at a 702 msec rate, the output of the third stage switches at a 1.404 sec. rate and so forth. As previously described, in the counter 145 of the preferred embodiment, output connections are made only to the tenth stage (outputs 265 and 266) whose signals appearing thereat switch at a 180 sec. rate, from the eighth stage (output 267) whose signals appearing thereat switch at a 45 second rate, and from the second stage (outputs 268 and 269) whose signals appearing thereat switch at a 702 msec rate.

The power latch network 146, the run latch network 147, the blower latch network 148 and the latch networks 470 and 475 each comprised of two NAND gates (providing set and clear outputs) with inputs and outputs cross-coupled in the conventional latching circuit configuration.

Specifically, the input 313 and the output 314 of NAND gate 315 are respectively "set" input and output terminals for the set state of the power latch circuit 146. The inputs 305 and 306 and the output 308 of the NAND gate 309 are respectively the "clear" input and output terminals for the clear state of the power latch 146.

The input 363 and the output 364 of the NAND gate 365 are respectively "set" input and output terminals for the set state of the run latch 147. The input 358 and the output 360 of the NAND gate 360 are respectively the clear input and output terminals for the clear state of the run latch 147.

The inputs 406 and 407 and the output 408 of the NAND gate 409 are respectively the set input and output terminals for the set state of the blower latch 148. The inputs 395 and 396 and the output 398 of the NAND gate 399 are respectively the clear input and output terminals for the clear state of the blower latch 148.

The latch networks 470 and 475 respectively have set inputs 471 and 476, and have clear inputs 469 and 474 respectively. Referring to FIG. 5, it will be noted that the set input 471 of the latch 470 is connected to the input 513 of the NAND gate 515 which provides the set state, and that the clear input 469 of the latch 470 is connected to the input 508 of the NAND gate 511 which provides the clear state. The latch networks 470 and 475 respectively have single latch outputs 472 and 477 which functionally correspond to the clear outputs of the previously described latches 146, 147 and 148.

All of the latch circuits within the guardian 30 operate in similar fashion. Whenever a logical low level is applied to one of a latch's set inputs, its set output (if it has one) will appear at a logical high level regardless of the logical level of the cross-coupled signal supplied to the set gate from the clear output portion of the latch network. Similarly, whenever a logical low level is applied to one of a latch's clear inputs, its clear output will appear at a logical high level regardless of the logical level of the cross-coupled signals applied to the clear gate from the set output portion of the latch network. The mechanics of latching networks are well known in the art and will not be further belaboured herein.

The blower sensor network 149 (FIGS. 4 and 6) operates in general, to sense whether or not a positive twelve volt potential is applied to the input terminal 119 of the blower motor 24 (FIG. 2). The blower sensor network 149 senses the voltage at the input 119 of the blower motor 24 through the contact 127 (FIG. 2), the conductor 128, the input 41 of the guardian and the conductor 438 (FIG. 6). A positive (12 volt) potential will appear at the input 119 of the blower 24 whenever the manual switch 120 of the blower is closed or whenever the blower enable energizing coil 592 of the relay 593 (FIG. 7) is energized to close the circuit between the terminals 125 and 127.

Referring to FIG. 6, it will be noted that the blower sensor 149 is a symmetrical circuit with diodes 452 and 453 connected in parallel and diodes 454 and 455 connected in parallel. This dual arrangement allows the blower sensor 149 to be adapted for sensing the energizing of multiple blowers. In such a case an additional input would be supplied to the blower sensor 149 to that point common to diodes 453 and 455, and the connecting path from the input 432 to the diode 453 (FIG. 6) would be eliminated. Such an arrangement would provide for separate base drives of the transistors 446 and 447 in response to sensed voltages or different blowers.

In the single blower sensing configuration of the preferred embodiment, a positive voltage appearing on conductor 438 when applied to the bases (*b*) of transistors 446 and 447 will drive these transistors into saturation causing a ground (plus the $V_{CE(Sat)}$ voltages of transistors 446 and 447) voltage to appear on the conductor 440. Consequently, an inverted (logical high) signal will appear on conductor 439. Whenever either the relay 593 or the manual switch 120 (FIGS. 7 and 2) has not closed the circuit between the contacts 125 and 127, the conductor 438 will be grounded through the blower motor 24, causing the transistors 446 and 447 to operate in cutoff, and enabling the voltage on conductor 440 to attain a logical high level equal to the plus five volt potential present on the positive power supply bus 180. In this mode of operation, the signal level appearing on conductor 439 will appear as a logical low.

The engine sensor network 150 in combination with the latch networks 470 and 475 generally sense the operative status of the engines (22(*a*) and (*b*)) within the engine compartment 21. As previously discussed, the engine sensor networks 150(*a*) and 150(*b*) are exact duals of each other in both construction and operation. Referring to FIGS. 2, 4 and 5, current pulses appearing at the output 75 of the ignition coil 76 are directly applied to the input 461 of the engine sensor 150(*a*) by means of the conductor 74, the input terminal 34 of the guardian 30 and the conductor 460. Since the current amplitude of the pulses appearing at the input 461 is generally large, the zener diode 495 clamps the voltage level of the pulses applied to the base (*b*) of transistor 491 to a 6 volt level to avoid damaging the transistor 491.

The engine sensor networks 150 mode of operation are essentially identical to that of the pulse generator circuit 142 previously described and will not, therefore, be described in detail. In general, the sensed ignition pulses applied to the base (*b*) of transistor 491 are converted into a shaped pulse train signal of negative going pulses appearing at the output 468 of the engine sensor 150(*a*) at approximately a 50 msec rate. The sensed shaped ignition pulses appearing at the output 468 are directly applied to the clear input 469 of the latch network 470 to repetitively clear the latch network 470 whenever the engine is running.

The set input 471 of the latch 470 is driven by the output 282 of the NAND gate 283. The inputs 280 and 281 of the NAND gate 283 are connected respectively to receive a periodic signal varying at a 351 msec rate (directly from the oscillator) and a periodic signal varying at a 702 msec rate (from the output 269 of the counter). The combined effect of the two signals received by the NAND gate 283 provides an output pulse train signal having truncated pulses appearing every 351 msec. Since the pulse train signal appearing on the conductor 480 and applied to the set input 471 of the latch 470 is much lower in frequency that the sensed shaped ignition pulse train signal applied to the clear input 469 of the latch 470, the latch 470 will be repetitively cleared as long as a signal is detected at the output 75 of the ignition coil 76. It is obvious, that the engine sensor 150(*b*), its latch network 475 and its associated interconnecting circuitry operate in an identical dual manner to that just described.

FIG. 7 generally illustrates the output drive circuits of the guardian 30. The warning indicator drive circuit 151 provides the drive signal for the warning indicator light 543. The collector (*c*) of transistor 535 directly drives the warning indicator light 543. When the transistor 535 is driven into saturation by a logical high at the output 530 of the NAND gate 531, the warning indicator light is energized by the 12 volt potential appearing at its input 544. The NAND gates 525 and 531 provide for logical selection of the drive mode of the warning indicator light 543. For example, the input 522 of the NAND gate 525 is directly connected to the output 269 of the counter 145 (FIG. 3) to receive a periodic signal therefrom varying at a 702 msec rate. Therefore, whenever the input 523 of the NAND gate 525 appears at a logical high, the output 524 of the NAND gate 525 will switch in response to the periodic signal applied to its input 522. Whenever the level of the signal applied to the input 523 of the NAND gate 525 appears at a logical low, the output 524 of NAND gate 525 will appear at a constant logical high level. Since the NAND gate 525 drives the NAND gate 531, the output 530 of the NAND gate 531 will be determined by the logical level of the signal applied to the input 529 of the NAND gate 531 when the output 324 is high. Therefore, under appropriate logical conditions, depending upon the inputs applied to the NAND gates 525 and 531, the warning indicator lamp 543 can be made to flash at a repetitive rate or to glow steady, or to be entirely extinguished.

The safety indicator drive circuit 152 operates in a manner identical with that previously described with respect to the output transistor stage 535 of the warning indicator light 151. When the transistor 552 is driven into saturation, a current path is established from the conductor 540 (at 12 volts) through the safety indicator light 547 and the saturated transistor 552 to the common 15. When the inverter 551 causes a logical low to appear at the base (*b*) of transistor 552, transistor 552 will be pulled into cutoff and the safety indicator light 547 will be extinguished.

The ignition enable drive circuit 153 and the blower enable drive circuit 154 are identical in construction and operation to that of the safety indicator drive circuit 152 with the exception that when their respective output transistors are driven into saturation, the ignition enable energizing coil 580 and the blower enable energizing coil 592 respectively are energized. When the coil 580 is energized, the movable contacts 583, 585, 587 and 598 of the relay 581 are simultaneously closed with their respective stationary contacts forming closed circuit electrical paths therebetween. When the coil 592 is energized, the movable contact 595 is pulled into electrical contact with the stationary contacts 594(*a*) and (*b*) closing the electrical path therebetween.

Operation During Power-Up Sequence

Referring to the Figures, the following sequence of events will occur with respect to a normal attempt to start the engines 22 within the engine compartment 21. The description will include only one engine 22(*a*), it being understood that the description can be generalized to include the second engine 22(*b*). The movable arm 84 of the ignition switch 83 when moved from electrical contact with its second stationary contact 85 (its OFF position) to electrical contact with its third stationary contact 86 (its ON position) will enable current flow from the positive terminal 51 of the battery 50 through the positive bus 16, the ignition switch 83, the conductor 88 to the input terminal 39 of the guardian 30. The positive potential applied to the input 39 of the guardian (FIG. 3) will energize the power supply as previously described enabling the power supply 140 to apply a positive 5 volt potential on the power supply bus 180. The power supply 140 energizes the logical components within the guardian 30.

Upon energization of the power supply 140, the power clear circuit 143 (FIG. 3) is energized by means of the power supply bus 180 and provides a low output pulse signal, as previously described, to the conductor 220. The low output pulse from the power clear circuit 143 is applied by means of the hard-wired OR gate 222 to the first reset input 262 of the counter 145 for clearing its first J-K flip-flop stage, and is applied to the first input 230 of the NAND gate 234 causing its output 233 to appear at a logical high level. The logical high at the output 234 is applied to the second and third reset inputs 263 and 264 respectively of the counter 145 as a logical low level resulting from the inversion by inverters 275 and 276. The logical low signals applied to the reset inputs 263 and 264 clear the second through tenth flip-flop stages of the counter 145. The counter 145 is therefore cleared to an all logical zero state.

Upon receiving a bias potential from the power supply bus 180 by means of the resistor 250, the pulse generator circuit 142 also provides a logical low pulse signal as previously described to the input 232 of the NAND gate 234 by means of the hard-wired OR gate 205. The logical low pulse from the pulse generator circuit 142 insures that the counter 145 is reset upon an initial power-up of the system.

The logical low output pulse from the power clear circuit 143 is also applied by means of the hard-wired OR gates 222 and 301 (FIG. 4) to the clear input 305 of the power latch 146, clearing the power latch and causing a logical high to appear at its clear output 308. The set output 314 of the power latch 146 will therefore appear at a logical low level since the set input 313 of the power latch 146 will be at a logical high. This results by reason of the logical low level applied from the output 265 of the counter 145 to the input 328 of the NAND gate 330.

The logical output signal appearing at the set output 314 of the power latch 146 is directly applied to the clear input 358 of the run latch 147, thereby clearing the run latch 147 and causing a logical low level to appear at its output conductor 375. The set output 364 of the run latch 147 will appear at a logical low level. This results by reason of the logical high condition of clear output 360 and by reason of a logical high level appearing at its set input 363. Since the set output 314 of the power latch network 146 is at a logical low, the output 353 of the NAND gate 354 will drive the set input 363 of the run latch 147 with a logical high signal.

The logical low appearing at the set output 314 of the power latch 146 is also directly applied to the clear input 396 of the NAND gate 399 of the blower latch 148, causing the clear output 398 of the blower latch 148 to appear at a logical high level. The set output 408 of the blower latch 148 will appear at a logical low level by reason of the logical high level appearing at the clear output 398 of the blower latch 148 and by reason of the application of logical high signals to both of the set inputs 406 and 407 of the blower latch 148. The set input 406 of the blower latch 148 will be driven by a logical high level from the NAND gate 374 as a result of its logical low driving input signal from the run latch 147. The set input 407 of the blower latch 148 will appear at a logical high level since both inputs of the NAND gate 343 are driven by logical low levels.

The set output 408 of the blower latch 148, therefore, provides a logical low output signal to the input 571 of the blower enable drive network 154 to energize the coil 592 of the relay 593. The circuit path between the terminals 41 and 42 of the guardian is therefore closed, and the blower 24 is enabled.

The counter 145 is disabled by the low output pulse signal from the power clear circuit for approximately 1.5 msec after which time the signal on the conductor 220 rises to its steady state a logical high level as previously described, enabling the oscillator 144 to advance the counter 145.

Also, during the power-up sequence, the warning indicator light 543 will be operable in its "flashing" mode, since the inputs 529 and 523 of NAND gates 531 and 525 will be at logical high levels. The warning indicator light will therefore be driven in a flashing mode from the 702 msec clock output 269 of the counter 145.

Normal Operation Following the Power-Up Sequence

The oscillator 144 will continue, after the initial power-up sequence, to advance the counter 145 for three minutes providing the following conditions are met: (1) The movable wiper arm 84 of the ignition switch 83 maintains contact with the third stationary contact 109 (the ON or START positions); and (2) the electrical circuit between the stationary contacts 125 and 127 leading to the blower motor 24 is closed, either by means of the manual switch 120 of the blower 24 or by the relay 593. The first condition (the continued positioning of the ignition switch 83 in its ON or START positions), is detected by means of the transistor 162 of the power supply circuit 140 (FIG. 3).

If the electrical circuit from the positive terminal 51 of the battery 50 through the ignition switch 83 is broken, the base drive transistor 162 into saturation will fail, and the power supply network 140 will cease to supply bias voltage to the circuits within the guardian, thereby disabling the system. The second condition (actual blower activation) is sensed by means of the blower sensor network 149 as previously discussed. If the blower sensor network 149 detects that the blower is not being energized a logical high level will appear at its output 435 and will be applied by means of the conductor 440 to the NAND gate 240 (FIG. 3). As will be apparent from an examination of the Figures, the logical states of the NAND gates 240, 248 and 234 under such conditions would enable a logical high level to appear at the output 233 of the NAND gate 234 thereby clearing the counter 145 by means of the inverters 275 and 276.

If the above conditions are met, the counter 145 advances to a count of 512 ( 3 minutes) at a rate of one count every three 351 msec. Upon attaining a count of 512, the signal levels at the outputs 265 and 266 from the tenth stage of the counter 145 switch (output 265 switching to a logical high and vice versa for output 266). The logical high appearing at output 265 of the counter is applied by means of the conductor 334 and the NAND gate 330 to the set input 313 of the power latch 146, thereby setting the power latch 146 causing a logical high level to appear at its output conductor 356. A logical high on the set output 314 of the power latch 146 will cause the clear output 308 of the power latch 146 to switch to a logical low level. This result is enabled since both of the clear inputs 305 and 306 of the power latch 146 are also now at a logical high level.

The resulting logical high appearing on conductor 178 will enable the hold circuit 142 (as previously described) to thereafter provide power to the power supply 140 for as long as the logical high level is maintained on the conductor 178. The logical high level appearing at the set output 314 of the power latch 146 enables the NAND gate 354 to provide a logical high set input signal to the set input 363 of the run latch 147 if the first and second aforementioned conditions remain satisfied. That is, the blower 24 must be energized as indicated by a logical high level on the conductor 439 from the blower sensor network 149, and the counter 145 must have been enabled to attain a count of 512 (3 minutes) as indicated by a logical high level appearing on the conductor 346. As a result, the set output 364 of the run latch 147 will appear at a logical high level which with the logical high from the set output 314 of the power latch 146 will reset the NAND gate 361 of the run latch 147, causing a logical low to appear at its clear output 360.

Until the run latch 147 is set, causing a logical high to appear at its set output 364, and a logical low to appear at its clear output 360, the safety indicator lamp 547 and the ignition enable driver circuit 153 are disabled. Therefore, prior to this condition current cannot flow through the ignition switch 83 (by means of the first set of contacts 582 of the relay 581) to enable the starter solenoid 55, even though the movable arm 84 of the ignition switch has been placed in its START position. Similarly, the electrical circuit through the ignition switch 83 to the ignition coil 78 is disabled by means of the second set of open contacts 584 of the relay 581.

When the set output 364 of the run latch 147 is set, the ignition enable drive circuit 153 energizes the coil 580 of the relay 581, simultaneously closing the contact pairs 582 and 584 for respectively enabling the energization of the starter solenoid 55 and the ignition coil 76 of the engine 66. The logical low level appearing at the clear output 360 of the run latch 147 will also energize the warning indicator light by 543 by means of the NAND gate 525 and 531 in its "steady" rather than "flashing" mode.

In summary, therefore, at this point in time the power hold network 141 is energized, the counter has advanced to a count of 512, the power and run latches 146 and 147 respectively are in their "set states," the blower latch 148 is in its "clear" state (its set output is logically low), the blower 24 is running, and the circuits between the battery 50 and the ignition coil 76 and starter motor 65 by means of the ignition switch 83 and the guardian 30 are enabled. If the ignition switch 83 remains in its ON position, the status of the electrical circuits within the guardian 30 will remain indefinitely in the states above described. It is obvious, that if the manual switch 120 of the blower 24 is positioned to close the circuit to the blower 24, the blower 24 will be energized directly from the battery 50 regardless of the state of the guardian 30 circuits.

Operation After Power-Up Sequence

Once the circuits within the guardian 30 have attained their "ready" status after the first uninterrupted three minute count sequence previously described, the engine 22(*a*) will be enabled to start and to run and the blower 24 will continue to run. The guardian 30 circuits will remain in their ready condition regardless of the number of attempts by an operator of the boat 20 to start the engines. That is, the guardian 30 circuits do not directly respond to the movement of the arm 84 of the ignition switch 83 from the ON to the START positions. Those conditions which will affect the operative state of the guardian 30 circuits when in their ready condition, are: (1) The movement of the movable arm 84 of the ignition switch 83 to its OFF position; and (2) an actual starting and continual running of the engines 22 within the engine compartment 21 for three consecutive minutes.

The operative status of the engines 22 is detected (as previously described) by the engine sensors 150. When the engines are not running, the outputs 472 and 477 of the latches 470 and 475 will both appear at logical low levels since the output 468 (FIG. 5) of the engine sensor 150 will appear at its steady state logical high level. Therefore, when the engines 22 are not running, the output 487 of the NAND gate 488 will provide a logical high input signal to the NAND gate 382.

The first input 378 of the NAND gate 382 will also appear at a logical high level when the guardian 30 circuits are in their ready condition since in such condition the set output 314 of the power latch 146 will appear at a logical high. Therefore, the output 381 of the NAND gate 382 will vary in direct response to the oscillating signal provided thereto by the NAND gate 289 (FIG. 3). Since the signal at the output 381 of the NAND gate 382 drives the third input 232 of the NAND gate 234 (FIG. 3) the counter 145 will be continually reset at a 702 msec rate, and the guardian 30 circuits will remain in their ready condition.

It will be noted that the NAND gate 488 requires that both engines 22 within the engine compartment 21 must be running (as detected by the engine sensors 150) before a logical low level will be supplied to the third input 380 of the NAND gate 382. When the engine sensor 150 senses current pulses from the coil to the distributor of an engine (as previously described) a pulse train of negative going pulses will appear at the output 468 of the engine sensor 150(*a*). It will be understood, that the same conditions will apply with respect to the engine sensor 150(*b*). The set input 471 of the latch 470 is being continually toggled by the output 282 of the NAND gate 283. Therefore, the NAND gate 515 of the latch 470 will be repetitively set. The clear gate 511 of the latch 470, however, will be repetitively cleared through its clear input 508 by the pulse train signal from the engine sensor 150(*a* ). When both engines are running, therefore, the output 487 of the NAND gate 488 will generally appear at a logical low level.

The oscillatory signals appearing at the outputs 282 and 288 of the NAND gates 283 and 289 respectively are phase separated by 300 msec. Therefore, although the second input 379 of the NAND gate 382 (FIG. 4) is being continually set from the signal output of the NAND gate 289, the low signal level applied to the third input 380 of the NAND gate 382 from the NAND gate 488 when the engines are simultaneously running, will negative the effect of the signal applied to the input 379. The signal level, therefore, appearing at the output 381 of the NAND gate 382 when the engines 22 are both running will be a logical high. The logical high at the output 381 of the NAND gate 382 enables the counter 145 by means of the NAND gate 234 to resume counting for a second three minute time period.

It will be noted, that the blower latch will continue to remain energized in its clear state, thus energizing the blower 24 throughout the three minute time interval. Upon attaining a count of 512 (3 minutes) the signal level appearing at the output 275 of the counter 145 will switch to a logical high level making all three inputs of the NAND gate 374 (FIG. 4) at logical high levels, causing its output 373 to appear at a logical low. The low signal at the output 373 will set the blower latch 148, causing a logical high level to appear at its set output 408, thereby deenergizing the coil 592 of the relay 593 and resulting in a deenergization of the blower motor 24.

In summary, therefore, if after the circuits within the guardian 30 are operative in their ready condition, both of the engines 22 within the engine compartment 21 are started and run continuously for three minutes, the blower 24 will be deenergized and a general power-down sequence of the circuits within the guardian 30 will be initiated.

Once the engines have successfully run for the 3 minute time interval such that the blower 24 would be deenergized, if at any time thereafter the one, or both, of the engines should turn off while its respective ignition switch is in its ON position, the blower latch 148 will be recleared and the blower 24 will be reenergized. This feature is provided by the operation of the engine sensors 150 and the NAND gate 382 which continuously (every 600 msec) sense the operative state of the engines. If the engine(s) stop running the output 487 of NAND gate 488 will appear at a logical high (as previously discussed), thus enabling the NAND gate 382 to be toggled by the clock signal applied to its input 379. When the output 381 of NAND gate 382 drops to a logical low, the blower latch 148 will be cleared and the blower will be energized. It will be recalled, that since the first stage of the counter 145 is not cleared with the second through tenth counter stages (due to its separate clear input 262), the 702 msec clock output signal appearing at its outputs 268 and 269 will continually be produced until a clear signal is applied to the input 262 of the counter.

If, after the circuits within the guardian 30 have attained their "ready" condition, the movable arm 84 of the ignition switch 83 is repositioned in its OFF position, the power supply 140 will be maintained in its operative mode by means of the power hold network 141 (as previously described). The power hold circuit 141 will continue to supply power to the power supply circuit 140 as long as the signal level appearing on conductor 178 is maintained at a logical high.

The signal on conductor 178 will remain at a logical high as long as the power latch 146 is maintained in a set condition. When the ignition switch 83 is placed in its OFF position, the voltage level applied to input 39 of the guardian 30 will drop, pulling transistor 191 of the pulse generator circuit into cutoff. The counter 145 which had been continually reset (after the initial 3 minute power-up sequence) by means of the NAND gate 234 due to the logical low on its input 232 is now enabled to resume counting toward a 512 count (3 minutes). The circuit path which enables the transistor 191 at cutoff to enable the counter 145 to resume counting consists of the conductor 193, the inverter 325, the conductor 336, the NAND gate 289 (output 288 at a logical high), the conductor 385, the inverter 386, the NAND gate 382 (output 381 at a logical high), the conductor 388, the OR gate 391, the conductor 206, the OR gate 205; the conductor 207 and the NAND gate 234 (output 233 at a logical low).

If the counter 145 should attain a count of 512 before the ignition switch 83 is repositioned to its ON postion, a logical high level appearing at the output 265 of the counter 145 will provide an input signal to the second input 321 of the NAND gate 323 which along with the logical high at its input 302 (resulting from the cutoff condition of transistor 191) will cause the output 322 of the NAND gate 323 to assume a logical low level, thereby setting the clear input 306 of the power latch 146. As a result, the clear output 308 of the power latch 146 will go to a logical high, thereby dropping the signal level on conductor 178 to a logical low and deenergizing the power hold circuit 141.

Therefore, once the ignition switch 83 is continuously repositioned in its OFF position for a time period of three minutes, the circuits within the guardian 30 will be disabled and the electrical path to the starter and coil 65 and 76 respectively of the engine 22(a) will be opened. The system must thereafter be completely recylced through the power-up sequence before the engine can be again enabled.

Whenever the ignition switch 83 is repositioned in its OFF position, when the guardian circuits are in their ready condition, the blower motor 24 will remain energized continually thereafter for a minimum time period of 45 seconds. This feature is provided by the NAND gate 343 which directly enables the blower latch 148. It will be recalled, that upon repositioning of the ignition switch 83 in its OFF position, the counter 145 will begin to advance for a three minute interval. When the counter 145 has continually counted for a time period of 45 seconds, a logical high level will appear at its output 267. thereby providing a logical high to the input 341 of the NAND gate 343. The input 340 of NAND gate 343 will already appear at a logical high since the transistor 191 (FIG. 3) is in cutoff. Therefore, the signal appearing at the output 342 of the NAND gate 343 will be at a logical low and will set the blower latch 148 through its set input 407. The set output 408 of the blower latch 148 will assume a logical high level and will deenergize the coil 592 of the relay 593.

If after the ignition switch 83 has been repositioned in its OFF position as above described, but is repositioned in its ON position before the counter 145 has advanced for 3 minutes, the counter 145 will be reset by means of the pulse generator circuit 142 as previously described. The circuits within the guardian 30, will thereafter resume their "ready" condition, and the blower 24 will be continually energized.

It will be understood, that although specific references to the second ignition switch 105 and its associated operations with respect to the operation of the second engine 22(b) were not made, within the prior discussions, the discussions with respect to the first engine 22(a) apply equally well thereto.

While the circuits first described employed specific time intervals for performing their control functions, it will be recognized that these specific time intervals are a matter of design choice and that other time intervals may equally well be employed without departing from the spirit or intent of this invention.

Also, although not illustrated in the Figures, a manual override capability is present in the system. The guardian 30 is installed in a boat's 20 electrical system, by means of a connector plug which operatively interrupts the normal signal path present in the boat's electrical system. If an operator decides to disable or remove the guardian from the boat's electrical system, for repair or otherwise, he must disconnect the connector plug from the guardian 30 and re-connect it in a manner in which it appeared prior to the inclusion of the guardian 30 in the system. Due to the peculiar configuration and signal path connections to the connector, such an operation may be performed within a matter of seconds.

While we have disclosed a specific embodiment of our invention, it is to be understood that this is for the purpose of illustration only, and that our invention is to be limited solely by the scope of the appended claims.

What is claimed is:

1. An electronic safety control apparatus for controlling the energization of an internal combustion engine of the type mounted in an enclosed engine compartment equipped with venting apparatus including an electrical blower operable when energized to ventilate the compartment, and in circuit with a battery, an electrical starter, an ignition coil and an ignition switch operable in conducting and non-conducting modes, the electronic safety control apparatus comprising:

a. first electronic switching means opeatively connected to the blower and to monitor the operative state of the ignition switch, responsive to a change in state of the ignition switch from its non-conducting mode to its conducting mode for continuously energizing the blower when the ignition switch is in its conducting mode and for automatically producing a continuous first enabling output signal delayed in time from the instant of said change in state of the ignition switch from its non-conducting mode to its conducting mode by a first predetermined time interval;

b. second electronic switching means operatively connected to the blower, to receive said first enabling signal and to monitor the operative state of the ignition switch, responsive to receipt of said first enabling signal and to change in state of the ignition swtich from its conducting mode to its non-conducting mode for producing a second continuous enabling signal over a second predetermined time interval and for continuously energizing the blower over a third predetermined time interval, said second and third predetermined time intervals beginning with said change in state of the ignition switch to its non-conducting mode;

c. blocking circuit means operatively connected in circuit with the starter and to receive said first and second enabling signals for electrically connecting and disconnecting the starter from energization, said blocking circuit means being normally operative in a first state to electrically disconnect the starter from energization and being operative in a second state when in receipt of said first or second enabling signals to electrically connect the starter for energization;

d. electronic engine sensing means operatively connected to the ignition coil for sensing electrical pulses passing through the ignition coil to energize the engine for providing a recylcing output signal after said sensed electrical pulses have continuously been applied to the engine for a fourth predetermined time interval, beginning with the first one of such sensed pulses; and e. recycling circuit means operatively connected to said electronic engine sensing means, responsive to receipt of said recycling output signal for recycling said first electronic switching means to de-energize the blower until a subsequent change in state of the ignition switch from its non-conducting mode to its conducting mode.

2. An electronic safety control apparatus according to claim 1, further includes electronic circuit means operatively connected with the ignition coil and with said blocking circuit means and responsive to a change in state of the ignition switch from its non-conducting mode to its conducting mode for automatically producing a continuous third enabling output signal delayed in time from the instant of said change in state of the ignition switch from its non-conducting mode to its conducting mode by said first predetermined time interval; and wherein said blocking circuit means further includes ignition blocking circuit means operatively connected with the ignition coil and to receive said third enabling output signal for electrically connecting and disconnecting the ignition coil for energization, said ignition blocking circuit means being normally operative in a first state to electrically disconnect the ignition coil from energization and being operative in a second state when in receipt of said third enabling output signal to electrically connect the ignition coil for energization.

3. An electronic safety control apparatus according to claim 1, wherein said first and second electronic switching means include electronic digital counter means for establishing said first, said second and said third predetermined time intervals.

4. An electronic safety control apparatus according to claim 1, further including blower switch means operatively connected to the battery and in parallel with said first switching means to the blower, responsive to manual stimulation for controlling energization of the blower, said blower switch means being normally operable in a first state to block energizing current flow to the blower and operable in a second state to energize the blower.

5. The combination with an internal combustion engine mounted in an engine compartment equipped with venting apparatus including an electrical blower operable when energized to ventilate the compartment, and in circuit with a battery, an electrical starter, an ignition coil and an ignition switch operable in conducting and non-conducting modes, of an electronic safety control apparatus comprising:

a. first electronic switching means operatively connected to the blower and to monitor the operative state of the ignition switch, responsive to a change in state of the ignition switch from its non-conducting mode to its conducting mode for continuously energizing the blower when the ignition switch is in its conducting mode and for automatically producing a continuous first enabling output signal delayed in time from the instant of said change in state of the ignition switch from its non-conducting mode to its conducting mode by a first predetermined time interval;

b. blocking circuit means operatively connected in circuit with the starter and to receive said first enabling signal for electrically connecting and disconnecting the starter for energization, said blocking circuit means being normally operative in a first state to electrically disconnect the starter from energization and being operative in a second state when in receipt of said first enabling signal to electrically connect the starter for energization;

c. electronic engine sensing means operatively connected to the ignition coil for sensing electrical pulses passing through the ignition coil to the engine and responsive to said sensed pulses for providing a recycling output signal immediately after said sensed electrical pulses have been continuously applied to the engine for a second predetermined time interval beginning with the first of such sensed pulses; and d. recycling circuit means operatively connected to said electronic engine sensing means and with said blower, responsive to receipt of said recycling signal for recycling said first electronic switching means and for de-energizing the blower until a subsequent change in state of the ignition switch from its non-conducting mode to its conducting mode.

6. The combination as recited in claim 5, wherein said first electronic switching means and said electronic engine sensing means include electronic digital counter means for establishing said first and second predetermined time intervals.

7. The combination as recited in claim 5, further including blower switch means and operatively connected to the battery and in parallel with said first switching means to the blower, responsive to manual stimulation for controlling energization of the blower, said blower switch means being normally operable in a first state to block energizing current flow to the blower and operable in a second state to energize the blower.

8. The combination as recited in claim 5, wherein said electronic engine sensing means includes means for providing a reenabling output signal whenever said sensed pulses are not continuously produced immediately following said second predetermined time interval, and wherein said recycling circuit means is operatively connected to received said reenabling output signal and is responsive thereto to re-energize said blower.

9. The combination as recited in claim 5, including digital logic circuit means operatively connected to the starter, to sense the operative states of the ignition switch and said first electronic switching means and to sense an energizing voltage signal applied to the blower for overriding said blocking circuit means, electrically disconnecting for energization the starter when the ignition switch is operative in its conducting mode and when the starter is electrically enabled for energization by said first switching means but said energizing voltage signal to the blower is insufficient to energize the blower.

10. The combination as recited in claim 5, wherein said first switching means further includes electronic circuit means operatively connected with the ignition coil and with said blocking circuit means, and responsive to a change in state of the ignition switch from its non-conducting mode to its conducting mode for automatically producing a continuous second enabling output signal delayed in time from the instant of said change in state of the ignition switch from its non-conducting mode to its conducting mode by said first predetermined time interval; and wherein said blocking circuit means further includes ignition blocking circuit means operatively connected with the ignition coil and to receive said second enabling output signal for electrically connecting and disconnecting the ignition coil for energization, said ignition blocking circuit means being normally operative in a first state to electrically disconnect the ignition coil from energization and being operative in the second state when in receipt of said second enabling output signal to electrically connect the ignition coil for energization.

11. The combination as recited in claim 5, wherein the recited electronic means of said safety control apparatus are housed within a compact guardian chassis having a pair of detachable connector means for normally operatively connecting said guardian electronic means with the battery, the electrical starter, the ignition coil and the ignition switch, said conductor means being detachable from said guardian circuit means for mutual connection with each other, providing manual override of the safety control apparatus circuits.

12. An electronic safety control apparatus for controlling the energization of an internal combustion engine of the type mounted in an enclosed engine compartment equipped with venting apparatus including an electrical blower operable when energized to ventilate the compartment, and in circuit with a battery, an electrical starter, an ignition coil and an ignition switch operable in conducting and non-conducting modes, the electronic safety control apparatus comprising:

a. first electronic switching means operatively connected to the blower and to monitor the operative state of the ignition swtich, responsive to a change in state of the ignition switch from its non-conducting mode to its conducting mode for continuously energizing the blower when the ignition switch is in its conducting mode and for automatically producing a continuous first enabling output signal delayed in time from the instant of said change in state of the ignition switch from its non-conducting mode to its conducting mode by a first predetermined time interval;

b. second electronic switching means operatively connected to the blower, to receive said first enabling signal and to monitor the operative state of the ignition switch, responsive to receipt of said first enabling signal and to change in state of the ignition switch from its conducting mode to its non-conducting mode for producing a second continuous enabling signal over a second predetermined time interval and for continuously energizing the blower over a third predetermined time interval, said second and third predetermined time intervals beginning with said change in state of the ignition switch to its non-conducting mode;

c. blocking circuit means operatively connected in circuit with the starter and to receive said first and second enabling signals for electrically connecting and disconnecting the starter for energization, said blocking circuit means being normally operative in a first state to electrically disconnect the starter from energization and being operative in a second state when in receipt of said first or second enabling signals to electrically connect the starter for energization; and d. digital logic circuit means operatively connected to the starter, to sense the operative states of the ignition switch and said first and second electronic switching means and to sense an energizing voltage signal applied to the blower for overriding said blocking circuit means, electrically disconnecting for energization the starter when the ignition switch is operative in its conducting mode and when the starter is electrically enabled for energization by said first or second electronic switching means but when said energizing voltage signal to the blower is insufficient to energize the blower.

* * * * *